US012595094B2

(12) United States Patent
Bakke

(10) Patent No.: US 12,595,094 B2
(45) Date of Patent: Apr. 7, 2026

(54) ERGONOMIC HANDLE

(71) Applicant: Daniel J Bakke, New York, NY (US)

(72) Inventor: Daniel J Bakke, New York, NY (US)

(73) Assignee: QUIRKY CUP, LLC, Minneapolis, MN (US)

( * ) Notice: Subject to any disclaimer, the term of this patent is extended or adjusted under 35 U.S.C. 154(b) by 0 days.

(21) Appl. No.: 18/632,191

(22) Filed: Apr. 10, 2024

(65) Prior Publication Data

US 2024/0343449 A1 Oct. 17, 2024

Related U.S. Application Data

(60) Provisional application No. 63/627,350, filed on Jan. 31, 2024, provisional application No. 63/495,306, filed on Apr. 11, 2023.

(51) Int. Cl.
*B65D 25/28* (2006.01)

(52) U.S. Cl.
CPC .... *B65D 25/2805* (2013.01); *B65D 2525/281* (2013.01)

(58) Field of Classification Search
CPC .... Y10T 16/44; B65D 25/28; B65D 25/2805; B65D 2525/281; B65D 23/10; B65D 2525/28; B65D 25/2811; B65D 2525/285
(Continued)

(56) References Cited

U.S. PATENT DOCUMENTS 5,683,007 A * 11/1997 Scholfield ..... A47G 23/03 220/756
6,010,030 A * 1/2000 St. John ..... A47J 43/0727 220/573.1

(Continued)

FOREIGN PATENT DOCUMENTS

EM 001982414-0018 2/2012
JP 2015037455 A 2/2015
WO WO-9746108 A2 * 12/1997 ..... A22B 5/166

OTHER PUBLICATIONS

Printualist—"S—Custom Monogram Coffee Mugs"—Amazon.com—First available Mar. 13, 2018—Retrieved from the Internet <URL: https://www.amazon.com/Custom-Monogram-Coffee-Personalized-Ceramic/dp/B07BFGSZCX?th=1>.
Gute—"Full Handwarmer Mug 12oz"—Amazon.com—First available Jun. 13, 2022—Retrieved from the Internet <URL: https://www.amazon.com.au/Handwarmer-Central-Fingers-Drinking-Favorite/dp/B0B3YB9ZYR>.

(Continued)

*Primary Examiner* — Rafael A Ortiz

(74) *Attorney, Agent, or Firm* — Gallium Law; Jacob Panangat; Michael Bakke

(57) ABSTRACT

Included in the present disclosure is a container, including a wall extending in at least a first direction and a second direction opposite the first direction and a base extending in at least a third direction and a fourth direction opposite the third direction. The container may include a handle extending in the fourth direction and including an interior and an exterior. The container may include an opening defined by at least a portion of the interior of the handle and a portion of the wall. The exterior of the handle may include a protrusion sized and configured to restably couple to a palm of the user. In some embodiments, the protrusion extends at least partially in the second direction and the fourth direction, and the protrusion curves away from the wall, and the protrusion tapers outward as it extends away from the opening thereby creating a tapered portion.

20 Claims, 13 Drawing Sheets

(58) Field of Classification Search
USPC ..... 220/752
See application file for complete search history.

(56) References Cited

U.S. PATENT DOCUMENTS

| | | | | | |
|---|---|---|---|---|---|
| 6,131,972 | A * | 10/2000 | Whitehead | B25G 1/102 | 16/DIG. 19 |
| 6,962,265 | B1 * | 11/2005 | Zhang | A47G 19/22 | 220/759 |
| D591,102 | S | 4/2009 | Zatzman | | |
| 8,544,668 | B2 * | 10/2013 | Nakayama | B65D 1/0223 | 220/759 |
| 11,399,644 | B1 | 8/2022 | Robillard | | |
| 2004/0164048 | A1 * | 8/2004 | Yourist | B65D 1/0223 | 215/396 |
| 2005/0241114 | A1 * | 11/2005 | Burney | B65D 25/32 | 16/445 |
| 2007/0262047 | A1 * | 11/2007 | Agrawal | B29C 49/04 | 215/398 |
| 2008/0173645 | A1 * | 7/2008 | Burstein | B67C 11/02 | 220/200 |
| 2009/0078712 | A1 * | 3/2009 | Zimmerman | A47G 19/2261 | 220/636 |
| 2011/0062171 | A1 * | 3/2011 | Copeland | A47G 19/2272 | 220/713 |
| 2011/0259891 | A1 * | 10/2011 | Thibault | B44D 3/14 | 224/195 |
| 2013/0048655 | A1 * | 2/2013 | Barth | A47G 23/0266 | 220/759 |
| 2016/0167827 | A1 * | 6/2016 | Arseneau | A47G 19/2266 | 220/669 |
| 2018/0079066 | A1 * | 3/2018 | Arseneau | A47G 19/22 | |

OTHER PUBLICATIONS

Momnt Mugs—"Momnt Mug"—Momntmugs.com—Retrieved on May 14, 2024, from the Internet <URL: https://www.momntmugs.com/>.

Clay in Motion Pottery Studio—"The Original Handwarmer Mug"—Clayinmotion.com—Retrieved on May 14, 2024, from the Internet <URL: https://www.clayinmotion.com/products/the-original-handwarmer-mug-brown-and-black-limited-edition>.

Climber Goods—"Rock Climbing Mug #2"—Etsy.com—Retrieved on May 14, 2024, from the Internet <URL: https://www.etsy.com/listing/257043857/rock-climbing-mug-2>.

White Chapel Pottery—"Small indent ceramic mug/thumbprint tumblers/minimalist tea cup"—Etsy.com—Retrieved on May 14, 2024, from the Internet <URL: https://www.etsy.com/listing/945447651/small-indent-ceramic-mugthumbprint?gpta=1&gao=1&&utm_source=google&utm_medium=cpc&utm_campaign=shopping_us_c-home_and_living-kitchen_and_dining-drink_and_barware-drinkware>.

Modern Artisans—"Modern Artisans American Made Stoneware Pottery Classic Wide Base Mug with Thumb Grip"—Amazon.com—First available Aug. 6, 2019—Retrieved from the Internet <URL: https://www.amazon.com/American-Stoneware-Pottery-Classic-Thumb/dp/B07W7BX83J?th=1>.

HLJGIFT—"Novelty Ceramic Coffee Mugs Gun Mugs Pistol Cup"—Amazon.com—First available Jun. 21, 2016—Retrieved from the Internet <URL: https://www.amazon.com/HLJgift-Novelty-Ceramic-Coffee-amazing/dp/B01HDNIQ0W?source=ps-si-shoppingads-ipcontext&ref_=fplfs&psc=1&smid=ASZ0EBA24KPUM>.

Arthritissupplies—"T Handle Coffee Mugs"—Arthritissupplies.com—Retrieved on May 14, 2024, from the Internet <URL: https://www.arthritissupplies.com/t-handle-mug.html>.

Blogblog—"Ceramic Espresso Cups with Wooden Handle"—Amazon.com—First available Feb. 14, 2023—Retrieved from the Internet <URL: https://www.amazon.com/dp/B0BVR2JSBZ/ref=twister_B0C4TL6W7Q?_encoding=UTF8&th=1>.

Bennington Potters—"Trigger Mug"—Benningtonpotters.com—Retrieved on May 14, 2024, from the Internet <URL: https://www.benningtonpotters.com/product/trigger-mug>.

Rehabilitation Advantage—"Rehabilitation Advantage Hand in Mug Adaptive Drinking Cup"—Amazon.com—Retrieved on May 14, 2024, from the Internet <URL: https://www.amazon.com/Rehabilitation-Advantage-Hand-Adaptive-Drinking/dp/B08DJRR152/ref=asc_df_B08DJRR152/tag=hyprod>.

Devine Medical—"Thumbs-Up Cup With Lid"—Devinemedical.com—Retrieved on May 14, 2024, from the Internet <URL: https://www.devinemedical.com/Thumbs-Up-Cup-Dishwasher-Safe-p/8455.htm>.

N, Kalina—"Fellow Boasts an Impressive & Minimalist Line of Products"—Trend Hunter—May 26, 2021—Retrieved from the Internet <URL: https://www.trendhunter.com/trends/minimalist-line>.

Wodden Edge—"Natural wooden coffee cup Hand made Kuska milk tea cup coffee mug"—Etsy.com—Retrieved on May 15, 2024, from the Internet <URL: https://www.etsy.com/listing/919860953/natural-wooden-coffee-cup-hand-made?variation0=1691234395>.

Levar—"Jamber Mug"—Ecommerce-demo.levar.io—Retrieved on May 15, 2024, from the Internet <URL: https://ecommerce-demo.levar.io/products/jamber-mug>.

* cited by examiner

ERGONOMIC HANDLE

CROSS-REFERENCE TO RELATED APPLICATIONS

The present application claims priority to U.S. Provisional Patent Application No. 63/495,306 filed on Apr. 11, 2023, entitled "A DRINKWARE HANDLE WITH FINGER SUPPORT" the entire disclosure of which is incorporated by reference herein.

The present application claims priority to U.S. Provisional Patent Application No. 63/627,350 filed on Jan. 31, 2024, entitled "DRINKWARE HANDLE" the entire disclosure of which is incorporated by reference herein.

Handles on drinkware have a long and varied history. They were initially designed for practicality, allowing people to hold hot or cold beverages without burning or chilling their hands. The ancient Greeks and Romans crafted pottery cups with rudimentary handles around 1500 BC. Over time, handles evolved in shape and material, with the Chinese inventing the first porcelain cups with loop handles around 600 AD.

During the Middle Ages in Europe, handles became more common on metal tankards and goblets, providing a sturdy grip for heavy vessels. By the 18th century, handles were integrated into various styles of ceramic teacups and coffee mugs, reflecting cultural preferences and design aesthetics.

In the 19th and 20th centuries, industrialization led to mass production of glassware and ceramics, allowing for standardized handle designs on cups, mugs, and glasses. Handles also became decorative elements, showcasing craftsmanship and artistic flair.

Today, handles on drinkware continue to serve both functional and aesthetic purposes, with modern materials like plastics and insulated metals offering new design possibilities while still honoring the tradition of the humble drinkware handle.

SUMMARY OF THE INVENTION

Included in the present disclosure is a container (e.g., the container 20 as shown in FIG. 1), including a wall (e.g., the wall 210 as shown in FIG. 2) extending in at least a first direction (e.g., the first direction 202 as shown in FIG. 2) and a second direction (e.g., the second direction 204 as shown in FIG. 2) opposite the first direction. In some embodiments, the container includes a base (e.g., the base 212 as shown in FIG. 2) located in the second direction and extending in at least a third direction (e.g., the third direction 206 as shown in FIG. 2) and a fourth direction (e.g., the fourth direction 208 as shown in FIG. 2) opposite the third direction. According to some embodiments, the container includes a handle (e.g., the handle 10 as shown in FIG. 1) extending in the fourth direction. The handle may include an interior (e.g., the interior 416 as shown in FIG. 4). In some embodiments, the handle includes an exterior (e.g., the exterior 418 as shown in FIG. 4) opposite the interior. According to some embodiments, the container includes an opening (e.g., the opening 302 as shown in FIG. 3) defined by at least a portion of the interior of the handle and at least a portion of the wall, whereby the portion of the interior of the handle and the portion of the wall form at least a portion of a perimeter about the opening, the opening configured to receive an index finger of a user. The exterior of the handle may include a protrusion (e.g., the bottom protrusion 312 as shown in FIG. 3) sized and configured to restably couple to a palm of the user. In some embodiments, the protrusion extends at least partially in the second direction and the fourth direction, and the protrusion curves away from the wall. According to some embodiments, the protrusion tapers outward as it extends away from the opening thereby creating a tapered portion sized and configured to restably couple to a finger of the user selected from the group consisting of a middle finger, a ring finger, a pinkie finger, and combinations thereof.

The portion of the interior of the handle and the portion of the wall may form a full perimeter about the opening. In some embodiments, the protrusion is a first protrusion, the exterior of the handle including a second protrusion (e.g., the top protrusion 308 as shown in FIG. 3) extending at least partially in the first direction and the fourth direction, the second protrusion sized and configured to maneuver the handle in response to manipulation from a thumb of the user.

According to some embodiments, the protrusion is a first protrusion, the exterior of the handle including a second protrusion (e.g., the middle protrusion 310 as shown in FIG. 3) extending at least partially in the fourth direction and sized and configured to restably couple to the palm between a thumb and the index finger of the user. The handle may be detachably coupled to the wall.

Also included in the present disclosure is a container, including a wall extending in at least a first direction and a second direction opposite the first direction. In some embodiments, the container includes a base located in the second direction and extending in at least a third direction and a fourth direction opposite the third direction. According to some embodiments, the container includes a handle extending in the fourth direction. The handle may include an interior. In some embodiments, the handle includes an exterior opposite the interior. According to some embodiments, the handle includes a first portion (e.g., the first portion 412 as shown in FIG. 4). The handle may include a second portion (e.g., the second portion 414 as shown in FIG. 4) opposite the first portion, the second portion closer to the base than the first portion. In some embodiments, the container includes an opening defined by at least a portion of the interior of the handle and at least a portion of the wall, whereby the portion of the interior of the handle and the portion of the wall form at least a portion of a perimeter about the opening, the opening configured to receive an index finger of a user. According to some embodiments, the exterior of the handle includes a protrusion sized and configured to restably couple to a palm of the user. The second portion may include a concave portion (e.g., the concave portion 314 as shown in FIG. 3) on the exterior of the handle, the concave portion configured to receive a middle finger of the user.

In some embodiments, the portion of the interior of the handle and the portion of the wall form a full perimeter about the opening. According to some embodiments, the second portion includes an indentation (e.g., the bottom indentation 306 as shown in FIG. 3) sized and configured to restably couple to the index finger of the user. The indentation may be formed on a face of the handle between the interior and the exterior, the indentation extending at least partially onto the protrusion.

In some embodiments, the first portion includes an indentation (e.g., the top indentation 304 as shown in FIG. 3) configured to maneuver the handle in response to manipulation from a thumb of the user. According to some embodiments, the indentation is formed on a face of the handle between the interior and the exterior.

The protrusion may include a concavity (e.g., the concavity 316 as shown in FIG. 3) sized and configured to restably couple to a finger of the user from the group consisting of a middle finger, a ring finger, a pinkie finger, and a combination thereof. In some embodiments, the protrusion includes a concavity sized and configured to restably couple to a finger of the user from the group consisting of a middle finger, a ring finger, a pinkie finger, and a combination thereof.

Also included in the present disclosure is a container, including a wall extending in at least a first direction and a second direction opposite the first direction. In some embodiments, the container includes a base located in the second direction and extending in at least a third direction and a fourth direction opposite the third direction. According to some embodiments, the container includes a handle extending in the fourth direction. The handle may include an interior. In some embodiments, the handle includes an exterior opposite the interior. According to some embodiments, the container includes an opening defined by at least a portion of the interior of the handle and at least a portion of the wall, whereby the portion of the interior of the handle and the portion of the wall form at least a portion of a perimeter about the opening, the opening configured to receive an index finger of a user. The exterior of the handle may include a first protrusion, the first protrusion sized and configured to restably couple to a palm of the user. In some embodiments, the first protrusion extends at least partially in the second direction and the fourth direction, and the first protrusion curves away from the wall. According to some embodiments, the exterior of the handle includes a second protrusion, the second protrusion sized and configured to maneuver the handle in response to manipulation from a thumb of the user.

The portion of the interior of the handle and the portion of the wall may form a full perimeter about the opening. In some embodiments, the first protrusion includes a concavity sized and configured to restably couple to a finger of the user from the group consisting of a middle finger, a ring finger, a pinkie finger, and a combination thereof. According to some embodiments, the exterior of the handle includes a third protrusion extending at least partially in the fourth direction and sized and configured to restably couple to the palm between a thumb and the index finger of the user.

The interior of the handle may include a third protrusion (e.g., the middle protrusion 810 as shown in FIG. 8) extending at least partially in the third direction and configured to maneuver the handle in response to manipulation from a middle finger of the user. In some embodiments, the third protrusion includes an indentation (e.g., the indentation 804 as shown in FIG. 8) configured to restably couple to the middle finger of the user. According to some embodiments, the handle is detachably coupled to the wall.

The foregoing, and other features and advantages of the invention, will be apparent from the following, more particular description of the preferred embodiments of the invention, the accompanying drawings, and the claims.

BRIEF DESCRIPTION OF DRAWINGS

These and other features, aspects, and advantages are described below with reference to the drawings, which are intended to illustrate, but not to limit, the invention. In the drawings, like characters denote corresponding features consistently throughout similar embodiments.

DETAILED DESCRIPTION OF THE INVENTION

Throughout the present disclosure, the term "semi-circular" is used to mean any arced segment of a circle that is greater than zero (0) degrees and less than three-hundred and sixty (360) degrees. Also, the term "circular" is used to mean any elliptical form that is enabled by the present disclosure.

While the present disclosure refers to components of the handle as circular or semi-circular, it is understood that this is not critical to the present disclosure. For example, there may be embodiments where there is no curvature in the handle, and instead, features may be presented with straight lines.

Current vessels for holding liquids and other items have flaws. These flaws come in the form of low stability. Those who hold these vessels for long periods of time may suffer fatigue, which in turn may further lower stability of the vessel being held, and lead to sloshing or spilling of the contents within the vessel. This may be especially true for those with weakened grip strength.

Thus, there is a need to provide vessels with features to lower or eliminate these deficiencies found in the prior art. The present disclosure serves to provide a handle including ergonomic features to improve stability and provide users with the ability to hold onto these vessels for longer periods of time.

Figure 1:
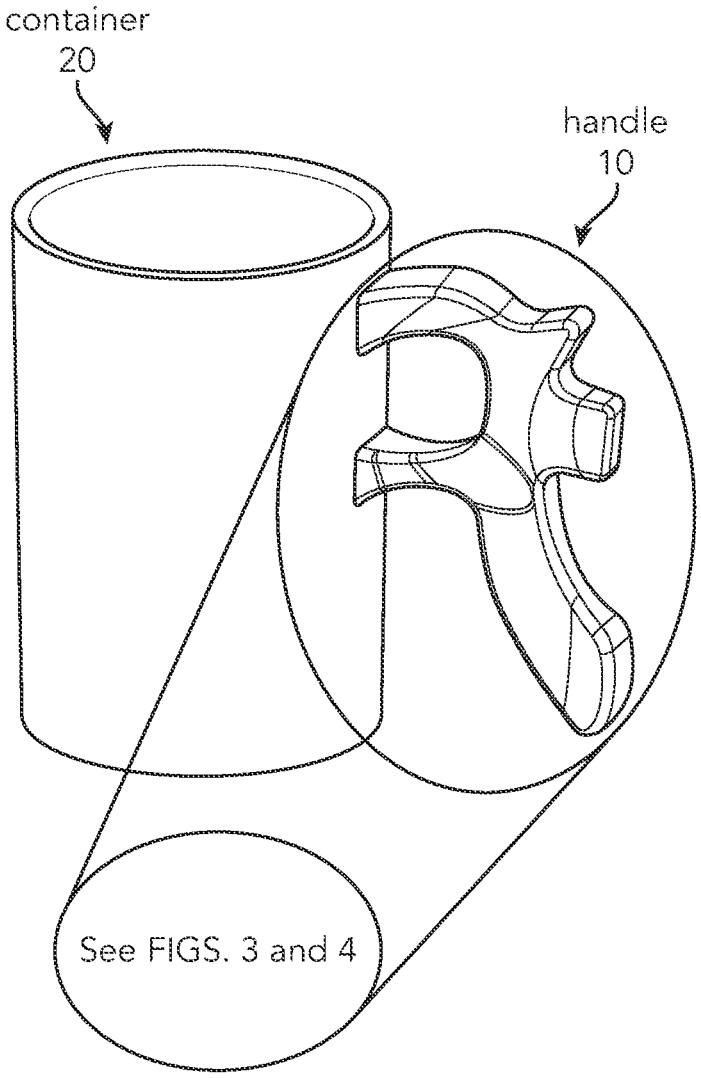
FIG. 1 illustrates a perspective view of a device, according to some embodiments.

FIG. 1 illustrates a perspective view of a device, according to some embodiments. This figure shows a handle 10 attached to the side of a container 20. The container 20 is illustrated in FIG. 1 as a hollow cylinder, however, this is not a requirement. The container 20 may be any sort of object that has an ability to contain something in a certain situation. The device in FIG. 1 appears to be a drinkware item, such as a mug or glass, although this is only one embodiment of the device and is understood to not be limiting. FIG. 1 also illustrates the handle 10 to include multiple structures, protrusions, indentations, and/or components. However, the handle 10 of FIG. 1 is understood to be one example of the form the handle 10 may take and is not limiting.

Figure 2:
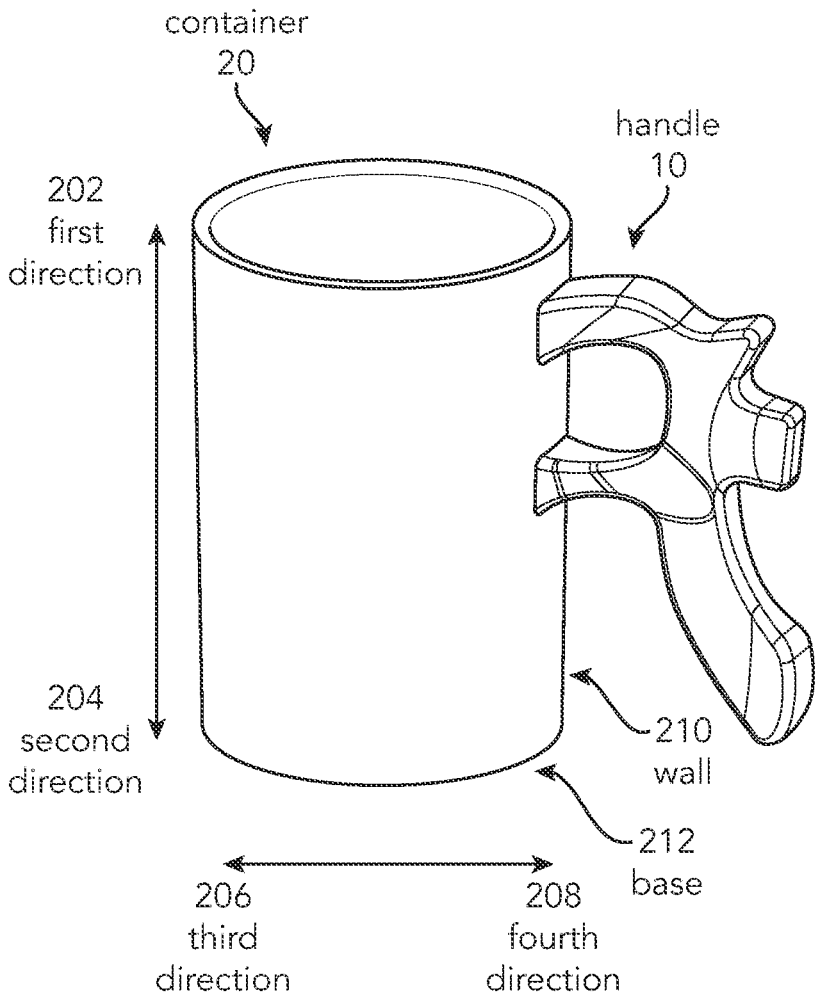
FIG. 2 illustrates an additional perspective view of the device of FIG. 1, according to some embodiments.

FIG. 2 illustrates an additional perspective view of the device of FIG. 1, according to some embodiments. FIG. 2 shows the handle 10 attached to the side of the container 20, similar to FIG. 1. This figure additionally illustrates the container 20 to include a wall 210 that may form the side of the container 20. In some embodiments, the handle 10 couples to the wall 210. According to some embodiments, the handle 10 detachably couples to the container 20 at the wall 210. FIG. 2 also shows the container 20 to include a base 212 at one end of the wall 210. The base 212 may completely enclose, partially enclose, or not enclose the end of the wall 210. Likewise, the wall 210 may extend about the entirety of the perimeter, or any portion of the perimeter, of the base 212. FIG. 2 illustrates the container 20 and the handle 10 similar to that of FIG. 1, although this is only one embodiment of the container 20 and the handle 10.

FIG. 2 also illustrates a first direction 202 extending from the middle of the container 20 and/or wall 210 toward one end of the container 20 and/or the wall 210. This figure additionally shows a second direction 204 opposite the first direction 202 and extending from the middle of the container 20 and/or wall 210 toward one end of the container 20 and/or wall 210 opposite that of the first direction 202. FIG. 2 further shows a third direction 206 and a fourth direction 208 opposite the third direction 206. In this figure, the third direction 206 is shown to be extending from the middle of the container 20 and/or base 212 away from the handle 10. The fourth direction is illustrated in this figure to extend from the middle of the container 20 and/or base 212 in the direction of the handle 10 and opposite that of the third direction 206.

Figure 3:
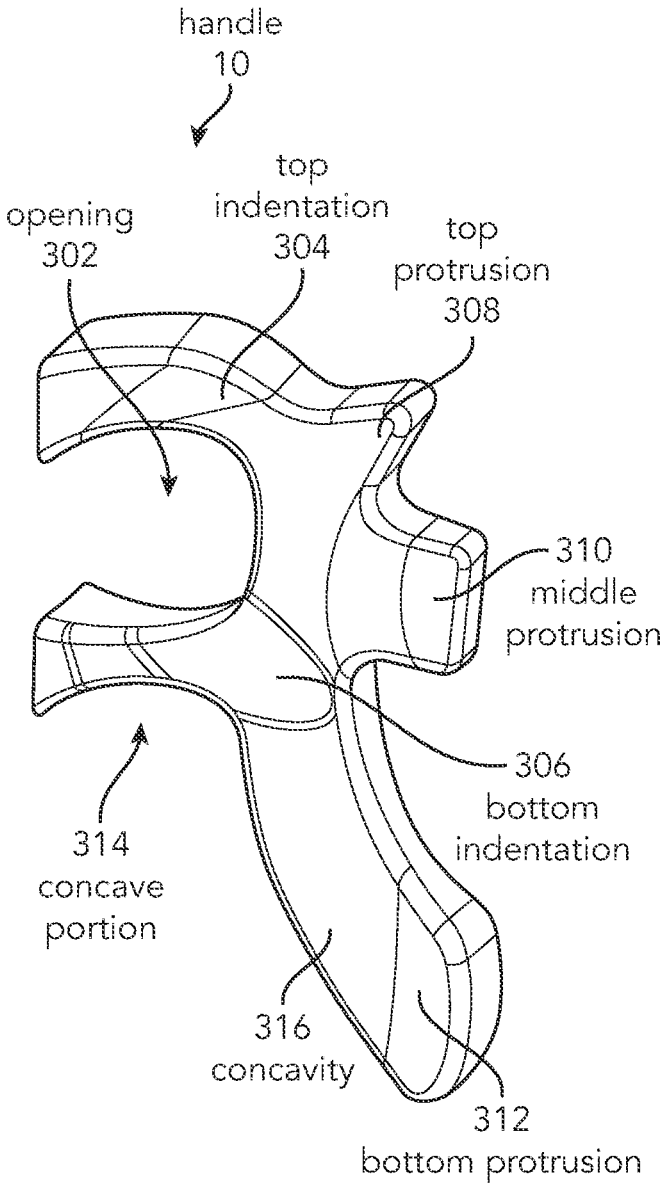
FIG. 3 illustrates a perspective view of a handle, according to some embodiments.

FIG. 3 illustrates a perspective view of a handle, according to some embodiments. This figure shows an opening 302 with a perimeter at least partially defined by the handle 10. Unlike FIGS. 1 and 2, which showed the handle 10 coupled to the container 20, FIG. 3 does not include the container 20. In some embodiments, the wall 210 of the container 20 forms at least a portion of the perimeter of the opening 302. The opening 302 may be sized and configured to receive a digit of a person using the handle 10. In some examples, the digit is an index finger.

FIG. 3 additionally illustrates a top indentation 304 and a bottom indentation 306, although it is understood that these indentations are not necessary for the handle 10 to function as intended. In some embodiments, the top indentation 304 is sized and configured to receive a digit of a person using the handle 10. According to some examples, the digit is a thumb. The top indentation 304 may be sized and configured to move and/or support the handle 10 in response to a force from a person using the handle 10. In some embodiments, the bottom indentation 306 is sized and configured to receive a digit of a person using the handle 10. According to some embodiments, the digit is an index finger and/or the digit received by the opening 302. While the top indentation 304 and the bottom indentation 306 use the terms "top" and "bottom," respectively, it is understood that these terms do not necessarily mean "upper" and "lower" and are used for clarity in reference to FIG. 3.

Also shown in FIG. 3 is a concave portion 314 located on the handle 10 opposite the opening 302. In some examples, the concave portion 314 is sized and configured to restably couple to a digit of a person using the handle 10. According to some examples, the digit is a middle finger.

FIG. 3 further illustrates a number of protrusions, specifically a top protrusion 308, a middle protrusion 310, and a bottom protrusion 312. Like the top indentation 304 and the bottom indentation 306, the terms "top," "middle," and "bottom" are used for clarity in reference to FIG. 3 and are not meant to be limiting. In some embodiments, the top protrusion 308 is sized and configured to restably couple to a digit of a person using the handle 10. According to some embodiments, the digit is a thumb. The top protrusion 308 may be sized and configured to move the handle 10 in response to a force from a person using the handle 10. In some embodiments, the middle protrusion 310 is sized and configured to restably couple to a palm of a person using the handle 10. The middle protrusion 310 may be sized and configured to support the handle 10 when a person is using the handle 10.

In some embodiments, the bottom protrusion 312 is sized and configured to restably couple to a palm of a person using the handle 10. The bottom protrusion 312 may be sized and configured to move the handle 10 in response to a force from a person using the handle 10 and/or support the handle 10 when a person is using the handle 10. FIG. 3 also illustrates a concavity 316 on the handle 10. In some examples, the concavity 316 is located on the bottom protrusion 312. According to some examples, the concavity 316 is sized and configured to restably couple at least one digit of a person using the handle 10. In some examples, the concavity 316 is sized and configured to restably couple a middle finger, a ring finger, and/or a pinkie finger of a person using the handle 10. The bottom protrusion 312 may be sized and configured to support the handle 10 when a person is using the handle 10. In some embodiments, the components of FIG. 3 allow for a hand of a person using the handle 10 to maintain its natural grip shape.

Stated another way, instead of a concavity 316, the bottom protrusion 312 may taper outwardly as the protrusion extends away from the opening 302. This taper may act in a similar manner to the concavity, permitting a more natural grip shape for the user.

Additionally, as shown in FIG. 3, the bottom protrusion 312 may gradually curve away from the container 20. This curvature also facilitates the use of a natural grip shape for a user.

Figure 4:
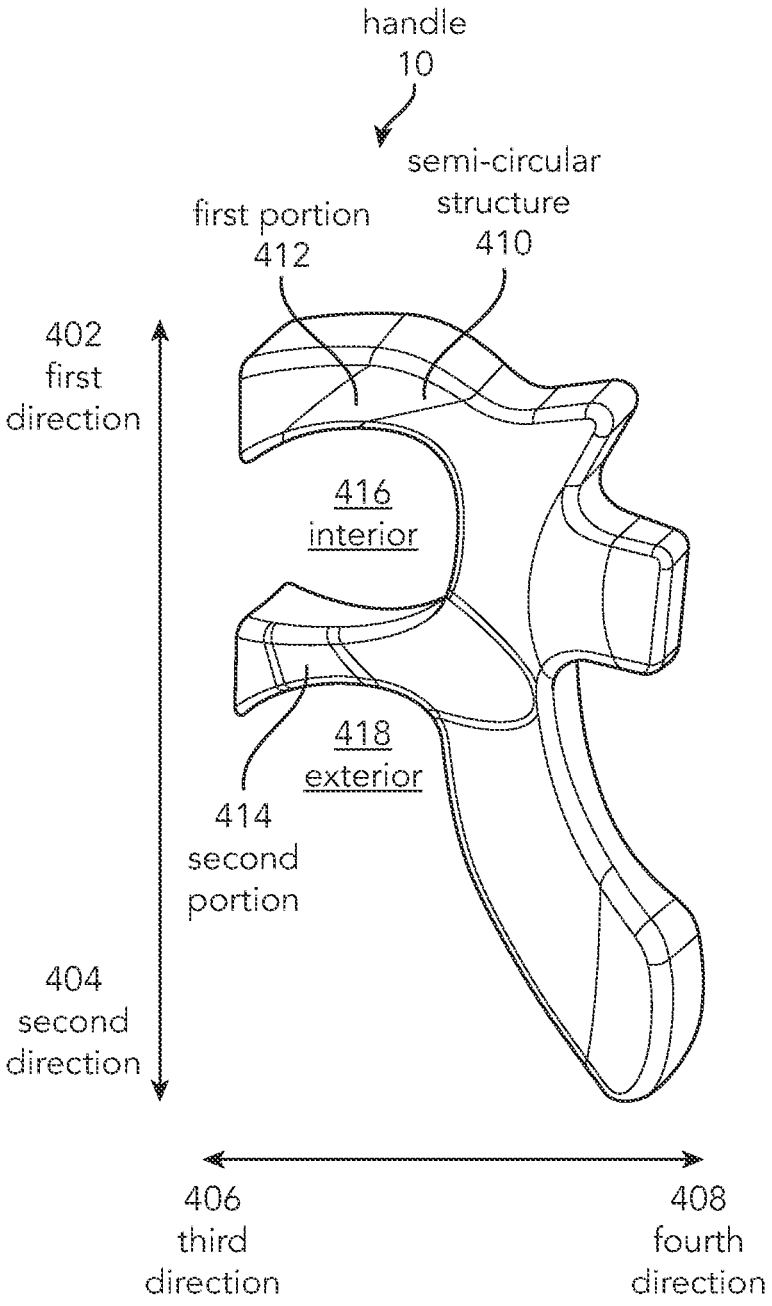
FIG. 4 illustrates an additional perspective view of the handle of FIG. 3, according to some embodiments.

FIG. 4 illustrates an additional perspective view of the handle of FIG. 3, according to some embodiments. This figure shows the handle 10 to include a semi-circular structure 410, which may be similar to an open ring or the like. Although the semi-circular structure 410 is illustrated in FIG. 4 as generally round, it is understood that the semi-circular structure 410 may be any rounded shape, such as a circle, elliptical, or the like. In some embodiments, the semi-circular structure 410 defines at least a portion of the opening 302 of FIG. 3. In other embodiments, the semi-circular structure 410 may define an entirety of the opening 302 of FIG. 3. The semi-circular structure 410 may include any or none of the top indentation 304, the bottom indentation 306, the top protrusion 308, the middle protrusion 310, the bottom protrusion 312, and/or the concave portion 314, as shown in FIG. 3.

FIG. 4 also illustrates a first direction 402 extending from the middle of the handle 10 toward one end of the handle 10. This figure additionally shows a second direction 404 opposite the first direction 402 and extending from the middle of the handle 10 toward one end of the handle 10 opposite that of the first direction 402. FIG. 4 further shows a third direction 406 and a fourth direction 408 opposite the third direction 406. In this figure, the third direction 406 is shown to be extending from the middle of the handle 10 away from the bottom protrusion 312. The fourth direction is illustrated in this figure to extend from the middle of the handle 10 in the direction of the bottom protrusion 312 and opposite that of the third direction 406.

Also shown in FIG. 4 is a first portion 412 and a second portion 414 opposite the opening 302 of the first portion 412. In some embodiments, the first portion 412 includes at least a portion of the top indentation 304 and/or the top protrusion 308. According to some embodiments, the second portion 414 includes at least a portion of the bottom indentation 306, the concave portion 314, and/or the bottom protrusion 312. At least a portion of the middle protrusion 310 may be included by the first portion 412 and/or the second portion 414. In some embodiments, the handle 10 may include only one of the first portion 412 and the second portion 414.

FIG. 4 additionally illustrates an interior 416 and an exterior 418 of the handle 10, the exterior 418 being opposite the first portion 412 and/or the second portion 414 from the interior 416. In some embodiments, the interior 416 includes at least a portion of the perimeter of the opening 302. According to some embodiments, the top indentation 304 and/or the bottom indentation 306 runs at least partially between the interior 416 and the exterior 418. At least a portion of the top protrusion 308, the middle protrusion 310, and/or the bottom protrusion 312 is coupled to the exterior 418. In some embodiments, the exterior 418 includes at least a portion of the concave portion 314 and/or the concavity 316.

Figure 5A:
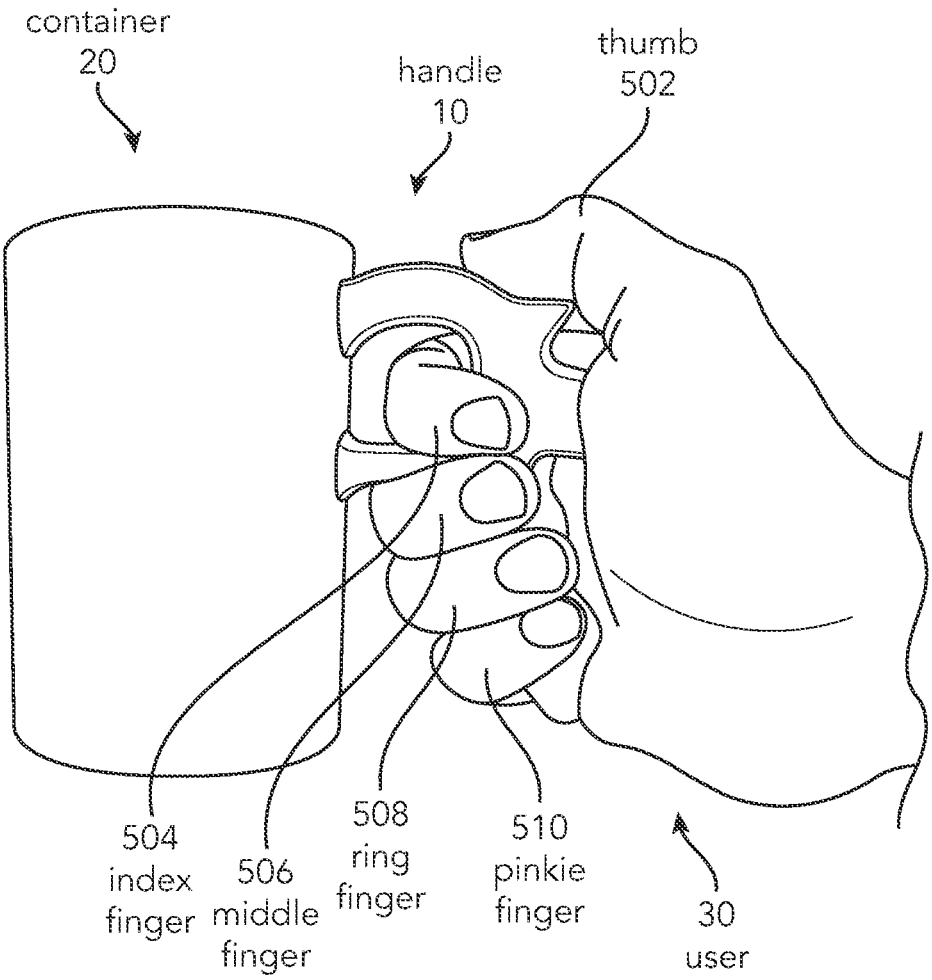
FIG. 5A illustrates a side view of a user holding the device of FIG. 1, according to some embodiments.

FIG. 5A illustrates a side view of a user holding a device, such as the device of FIG. 1, according to some embodiments. This figure shows the handle 10 coupled to the container 20 with a user 30 holding the container 20 by the handle 10. FIG. 5A illustrates a thumb 502 of the user 30 to be restably coupled to the top protrusion 308. In some embodiments, the placement of the thumb 502 of the user 30 allows the user 30 stability in holding the handle 10 of the container 20. This stability may be caused in part by the user 30 gaining additional rotational control of the handle 10, thereby keeping the handle 10 from slipping in the grasp of the user 30 and allowing the container 20 to tip unexpectedly.

FIG. 5A also illustrates a hand of the user 30 grasping the handle 10, with an index finger 504 of the user 30 extending through the opening 302. This figure also shows the index finger 504 of the user 30 restably coupled to the bottom indentation 306. In some embodiments, extending the index finger 504 through the opening 302 and restably coupling it to the bottom indentation 306 allows the user 30 improved control over the handle 10 and the container 20. This improved control may be due to an increased surface area of contact between the index finger 504 and the handle 10. According to some embodiments, the improved control is due to the user 30 keeping the index finger 504 in the opening 302 and creating and maintaining control of a rotation point at the opening 302.

Additionally, FIG. 5A shows the middle protrusion 310 restably coupled to a palm of the user 30. In some embodiments, the middle protrusion 310 is coupled to the palm of the user 30 near where the index finger 504 restably couples to the bottom indentation 306. According to some embodiments, the proximity of the middle protrusion 310 and the bottom indentation 306 allows the user 30 to push the handle 10 into the palm using the index finger 504. This use of the index finger 504 may provide the user 30 with increased stability of the handle 10 by allowing the user 30 to firmly push the middle protrusion 310 into their palm.

FIG. 5A also illustrates the second portion 414 to be in between the index finger 504 and a middle finger 506 of the user 30, with the middle finger 506 restably coupled to the concave portion 314. This may allow the weight of the container 20 and the handle 10 to partially rest upon the middle finger 506 of the user 30, as well as to provide stability to the container 20 and the handle 10 by allowing the user 30 to press the second portion 414 between the index finger 504 and the middle finger 506.

Next to the middle finger 506 in FIG. 5A is the ring finger 508, followed by the pinkie finger 510 of the user 30. FIG. 5A illustrates the middle finger 506, the ring finger 508, and the pinkie finger 510 to be at least partially wrapped around the bottom protrusion 312 with at least one of these fingers restably coupled to the concavity 316. Additionally, the bottom protrusion 312 is shown to be in at least partial contact with the palm of the user 30. In some embodiments, wrapping these three fingers at least partially around the bottom protrusion 312 and/or restably coupling the bottom protrusion 312 and the palm of the user 30 allows the user 30 to gain additional stability of the container 20 and the handle 10. This may be due in part to the user 30 having a portion of the handle 10 for additional portions of their hand to hold on to and/or restably couple to.

Figure 5B:
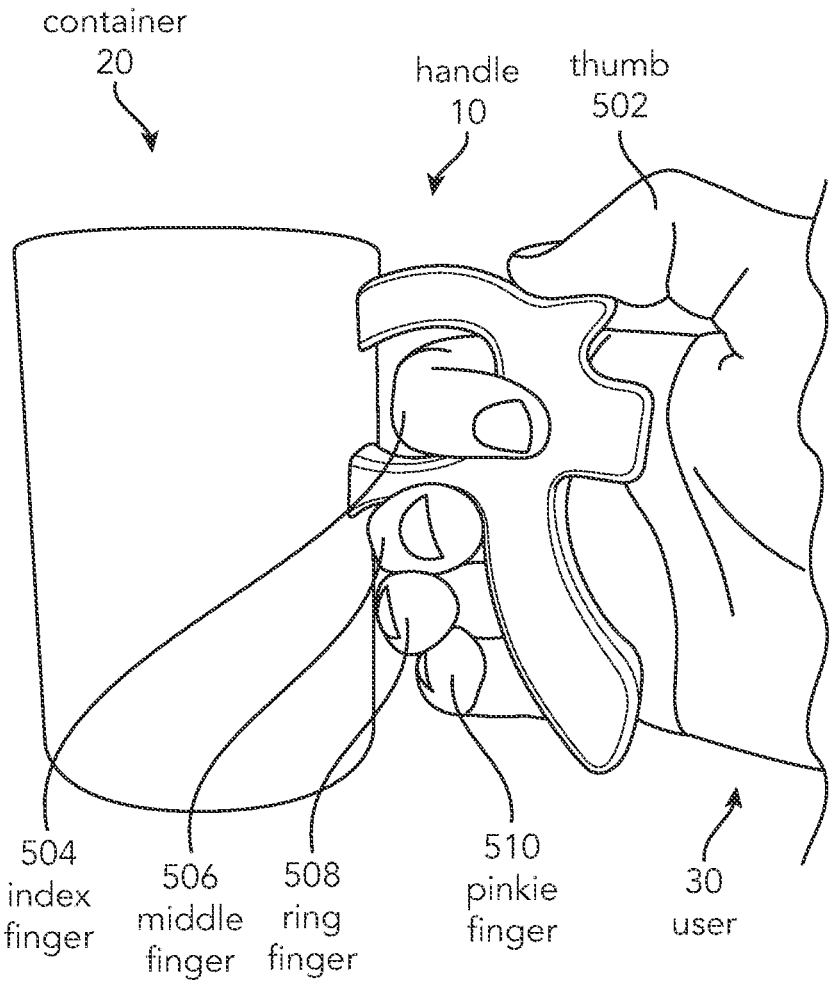
FIG. 5B illustrates an additional side view of a user holding the device of FIG. 1, according to some embodiments.

FIG. 5B illustrates an additional side view of a user holding a device, such as the device of FIG. 1, according to some embodiments. This figure shows a similar view to that of FIG. 5A but illustrates the hand of the user 30 to be at least partially open. In some embodiments, the hand in this figure is beginning to grip or release the handle 10 but has not yet completed the process. Like FIG. 5A, FIG. 5B illustrates the thumb 502 of the user 30 restably coupled to the top protrusion 308, the index finger 504 extending into and/or through the opening 302, the middle finger 506 restably coupled to the concave portion 314, and the middle finger 506, the ring finger 508, and the pinkie finger 510 at least partially in contact with the bottom protrusion 312. However, as opposed to FIG. 5A, the palm of the user 30 is shown in FIG. 5B to be in less and/or no contact with the middle protrusion 310 and/or the bottom protrusion 312.

Figure 5C:
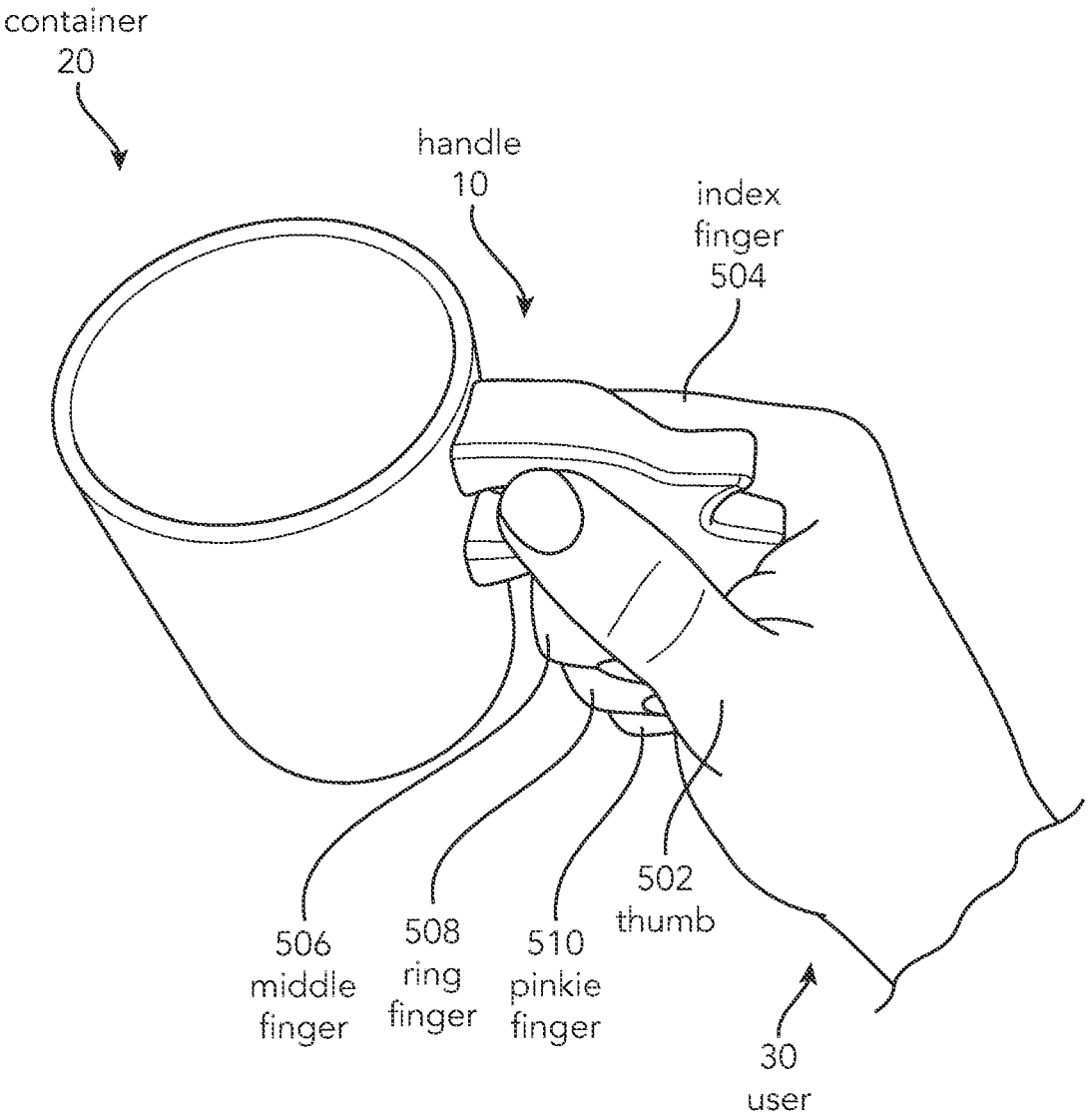
FIG. 5C illustrates a perspective view of a user holding the device of FIG. 1, according to some embodiments.

FIG. 5C illustrates a perspective view of a user holding a device, such as the device of FIG. 1, according to some embodiments. This figure shows the user 30 holding the handle 10 of the container 20 in a similar way to that of FIGS. 5A and 5B. However, the thumb 502 of the user 30 is restably coupled to the top indentation 304 in FIG. 5C, as opposed to the top protrusion 308 as shown in FIGS. 5A and 5B. In some embodiments, the placement of the thumb 502 of the user 30 allows the user 30 stability in holding the handle 10 of the container 20. This stability may be caused in part by the user 30 gaining additional rotational control of the handle 10, thereby keeping the handle 10 from slipping in the grasp of the user 30 and allowing the container 20 to tip unexpectedly. In some embodiments, the restable coupling of the thumb 502 in the top indentation 304 allows for increased stability for the user 30 when tipping the container 20 and the handle 10 in a similar way as to that shown in FIG. 5C.

Figure 6:
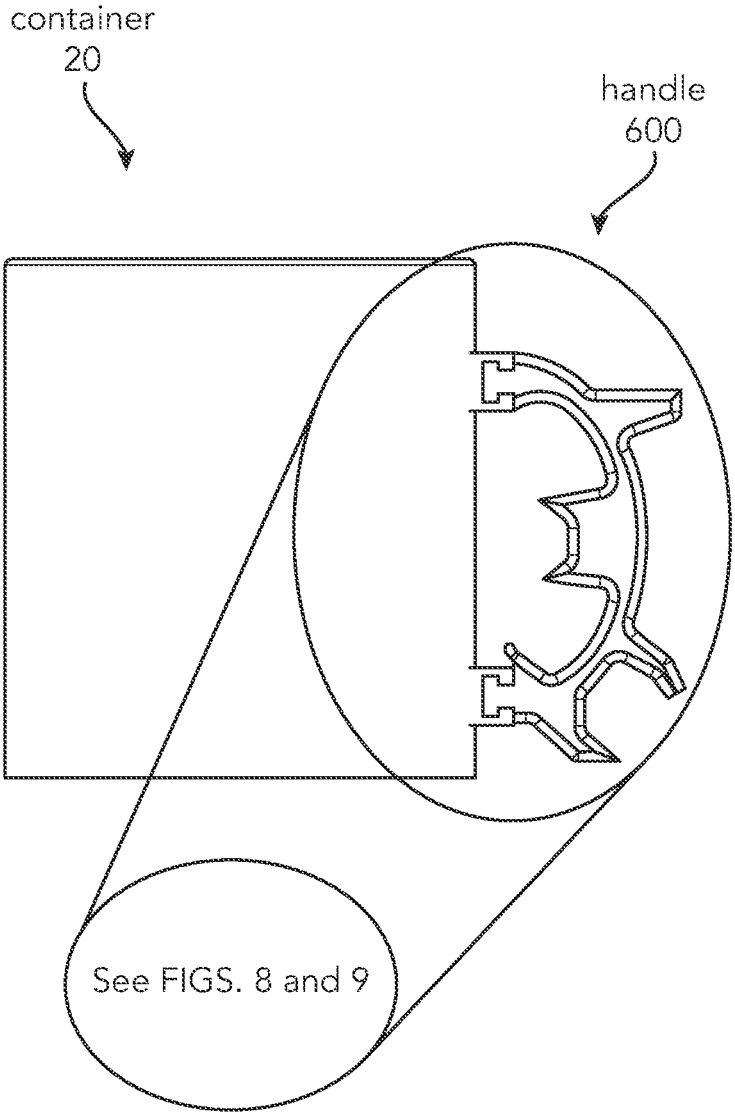
FIG. 6 illustrates a side view of a device, according to some embodiments.

FIG. 6 illustrates a side view of a device, according to some embodiments. This figure shows a handle 600 attached to the side of a container 20. The container 20 is illustrated in FIG. 6 as having a generally square or rectangular side profile, however, this is not a requirement. The container 20 may be any sort of object that has an ability to contain something in a certain situation. The device in FIG. 6 appears to be a drinkware item, such as a mug or glass, although this is only one embodiment of the device and is understood to not be limiting. FIG. 1 also illustrates the handle 600 to include multiple structures, protrusions, indentations, and/or components. However, the handle 600 of FIG. 6 is understood to be one example of the form the handle 600 may take and is not limiting.

Figure 7:
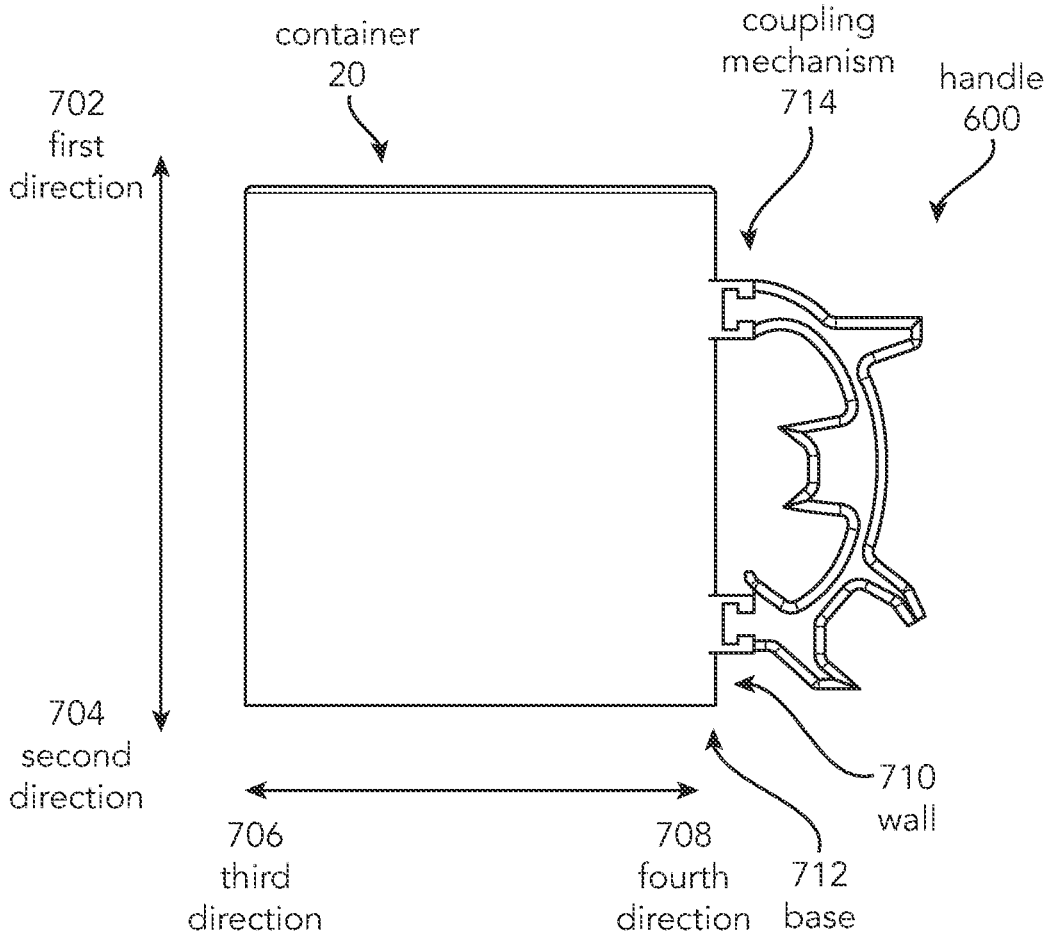
FIG. 7 illustrates an additional side view of the device of FIG. 6, according to some embodiments.

FIG. 7 illustrates an additional side view of the device of FIG. 6, according to some embodiments. FIG. 7 shows the handle 600 attached to the side of the container 20, similar to FIG. 1. The handle 600 is shown in FIG. 7 to be attached to the container 20 at and/or by a coupling mechanism 714. The coupling mechanism 714 may be anything that allows the handle 600 to couple to the container 20. This figure additionally illustrates the container 20 to include a wall 710 that may form the side of the container 20. In some embodiments, the handle 600 couples to the wall 710. According to some embodiments, the handle 600 detachably couples to the container 20 at the wall 710. The coupling may be via the coupling mechanism 714. FIG. 7 also shows the container 20 to include a base 712 at one end of the wall 710. The base 712 may completely enclose, partially enclose, or not enclose the end of the wall 710. FIG. 7 illustrates the container 20 and the handle 600 similar to that of FIG. 6, although this is only one embodiment of the container 20 and the handle 600.

FIG. 7 also illustrates a first direction 702 extending from the middle of the container 20 and/or wall 710 toward one end of the container 20 and/or the wall 710. This figure additionally shows a second direction 704 opposite the first direction 702 and extending from the middle of the container 20 and/or wall 710 toward one end of the container 20 and/or wall 710 opposite that of the first direction 702. FIG. 7 further shows a third direction 706 and a fourth direction 708 opposite the third direction 706. In this figure, the third direction 706 is shown to be extending from the middle of the container 20 and/or base 712 away from the handle 600. The fourth direction is illustrated in this figure to extend from the middle of the container 20 and/or base 712 in the direction of the handle 600 and opposite that of the third direction 706.

Figure 8:
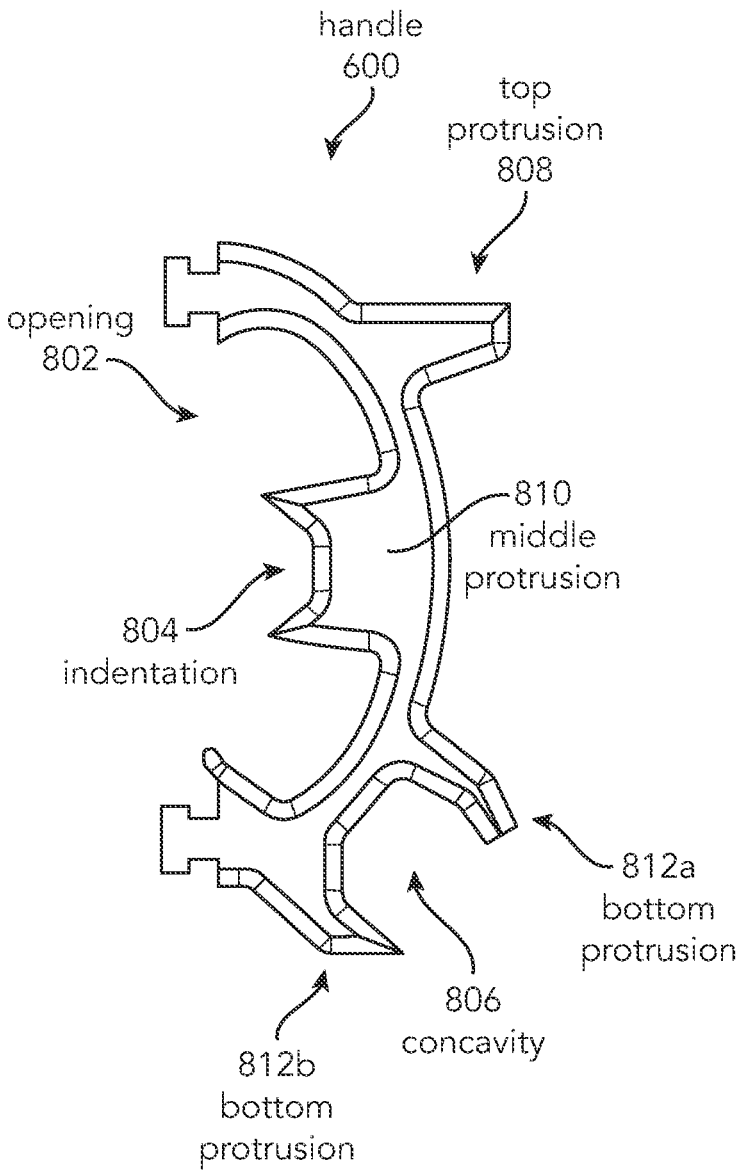
FIG. 8 illustrates a side view of a handle, according to some embodiments.

FIG. 8 illustrates a side view of a handle, according to some embodiments. This figure shows an opening 802 with a perimeter at least partially defined by the handle 600. Unlike FIGS. 6 and 7, which show the handle 600 coupled to the container 20, FIG. 8 does not include the container 20. In some embodiments, the wall 710 of the container 20 forms at least a portion of the perimeter of the opening 802. The opening 802 may be sized and configured to receive at least one digit of a user 30.

FIG. 8 additionally illustrates an indentation 804, although it is understood that this indentation is not necessary for the handle 600 to function as intended. In some embodiments, the indentation 804 is sized and configured to receive a digit of a user 30. According to some examples, the digit is a middle finger 506. The indentation 804 may be sized and configured to move and/or support the handle 600 in response to a force from a user 30.

FIG. 3 further illustrates a number of protrusions, specifically a top protrusion 808, a middle protrusion 810, and at least one bottom protrusion 812. While the top protrusion 808, the middle protrusion 810, and the bottom protrusion 812 use the terms "top," "middle," and "bottom," respectively, it is understood that these terms do not necessarily mean "upper," "middle-most," and "lower" and are used for clarity in reference to FIG. 8. In some embodiments, the top protrusion 808 is sized and configured to restably couple to a digit of a user 30. According to some embodiments, the digit is a thumb 502. The top protrusion 808 may be sized and configured to move the handle 600 in response to a force from a user 30. According to some embodiments, the space between the top protrusion 808 and the bottom protrusion 812 restably couples to the palm of a user 30. This may allow the user 30 to gain additional stability when holding the handle 600.

In some embodiments, the middle protrusion 810 includes an indentation 804 and is sized and configured to restably couple to a middle finger 506 of a user 30. The middle protrusion 810 may be sized and configured to support the handle 600 when the handle 600 is in use. The indentation 804 may be sized and configured to move and/or support the handle 600 in response to a force from a user 30.

Also shown in FIG. 8 is a concavity 806 located on the handle 600 opposite the opening 802. The concavity 806 may be located between two instances of the bottom protrusion 812, shown in FIG. 8 as 812*a* and 812*b*. In some examples, the concavity 806 is sized and configured to restably couple to a digit of a user 30. According to some examples, the digit is a pinkie finger 510. At least one of the bottom protrusion 812 and the concavity 806 may be sized and configured to move and/or support the handle 600 in response to a force from the user 30. In some embodiments, the components of FIG. 8 allow for a hand of a user 30 to maintain its natural grip shape.

Figure 9:
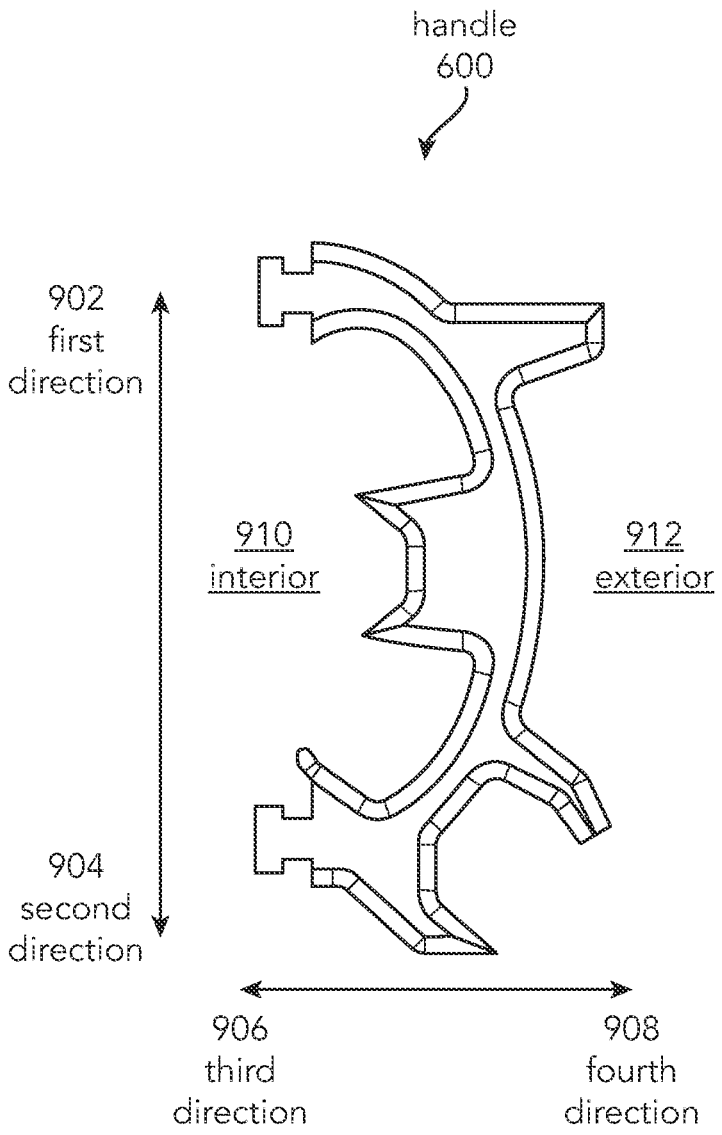
FIG. 9 illustrates an additional side view of the handle of FIG. 8, according to some embodiments.

FIG. 9 illustrates an additional side view of the handle of FIG. 8, according to some embodiments. This figure shows a first direction 902 extending from the middle of the handle 600 toward one end of the handle 600. This figure additionally shows a second direction 904 opposite the first direction 902 and extending from the middle of the handle 600 toward one end of the handle 600 opposite that of the first direction 902. FIG. 9 further shows a third direction 906 and a fourth direction 908 opposite the third direction 906. In this figure, the third direction 906 is shown to be extending from the middle of the handle 600 away from the bottom protrusion 812. The fourth direction is illustrated in this figure to extend from the middle of the handle 600 in the direction of the bottom protrusion 812 and opposite that of the third direction 906.

FIG. 9 also shows the handle 600 to be a general semicircular shape, which may be similar to an open ring or the like. Although the shape of the handle 600 is illustrated in FIG. 9 as generally round, it is understood that the handle 600 may be any rounded shape, such as a circle, elliptical, or the like.

Also illustrated in FIG. 9 is an interior 910 and an exterior 912 of the handle 600, the exterior 912 being across the body of the handle and opposite from the interior 910. In some embodiments, the interior 910 includes at least a portion of the perimeter of the opening 802. According to some embodiments, the interior 910 includes at least a portion of the indentation 804 and/or the middle protrusion 810. At least a portion of the top protrusion 808, the middle protrusion 810, and/or the bottom protrusion 812 is coupled to the exterior 912. In some embodiments, the exterior 912 includes at least a portion of the concavity 806.

Figure 10A:
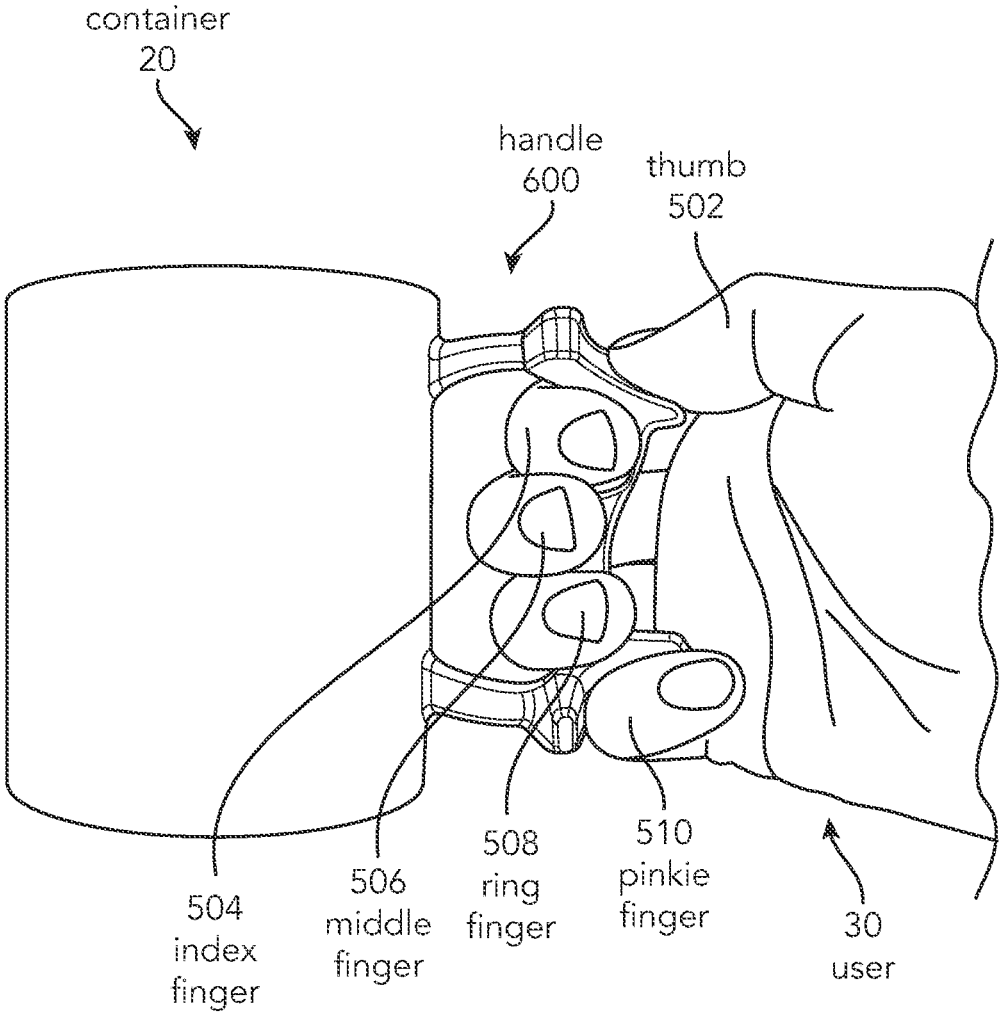
FIG. 10A illustrates a side view of a user holding the device of FIG. 6, according to some embodiments.

FIG. 10A illustrates a side view of a user holding a device, such as the device of FIG. 6, according to some embodiments. This figure shows the handle 600 coupled to the container 20 with a user 30 holding the container 20 by the handle 600. FIG. 10A illustrates a thumb 502 of the user 30 to be restably coupled to the top protrusion 808. In some embodiments, the placement of the thumb 502 of the user 30 allows the user 30 stability in holding the handle 600 of the container 20. This stability may be caused in part by the user 30 gaining additional rotational control of the handle 600, thereby keeping the handle 600 from slipping in the grasp of the user 30 and allowing the container 20 to tip unexpectedly.

FIG. 10A also illustrates a hand of the user 30 grasping the handle 600, with an index finger 504, the middle finger 506, and the ring finger 508 of the user 30 extending through the opening 802. In some embodiments, extending these fingers through the opening 802 and restably coupling them to the handle 600 allows the user 30 improved control over the handle 600 and the container 20. This improved control may be due to an increased surface area of contact between the index finger 504, the middle finger 506, and/or the ring finger 508 and the handle 600. According to some embodiments, the improved control is due to the user 30 keeping the index finger 504, the middle finger 506, and/or the ring finger 508 in the opening 802 and creating and maintaining control of a rotation point at the opening 802.

Additionally, FIG. 10A shows the middle finger 506 of the user 30 restably coupled to the indentation 804 in the middle protrusion 810. In some embodiments, extending the middle finger 506 through the opening 802 and restably coupling it to the indentation 804 allows the user 30 improved control over the handle 600 and the container 20. In some embodiments, the middle protrusion 810 allows the user 30 to push the handle 600 into the palm using the middle finger 506. This use of the middle finger 506 may provide the user 30 with increased stability of the handle 600 by allowing the user 30 to firmly push the space between the top protrusion 808 and the bottom protrusion 812 into their palm.

FIG. 10A also illustrates the pinkie finger 510 of the user 30 to be restably coupled to the concavity 806 and/or the bottom protrusion 812*a* and/or 812*b*. This may allow the weight of the container 20 and the handle 600 to partially rest upon the pinkie finger 510 of the user 30, as well as to provide stability to the container 20 and the handle 600 by allowing the user 30 to press the handle 600 between the ring finger 508 and the pinkie finger 510.

Figure 10B:
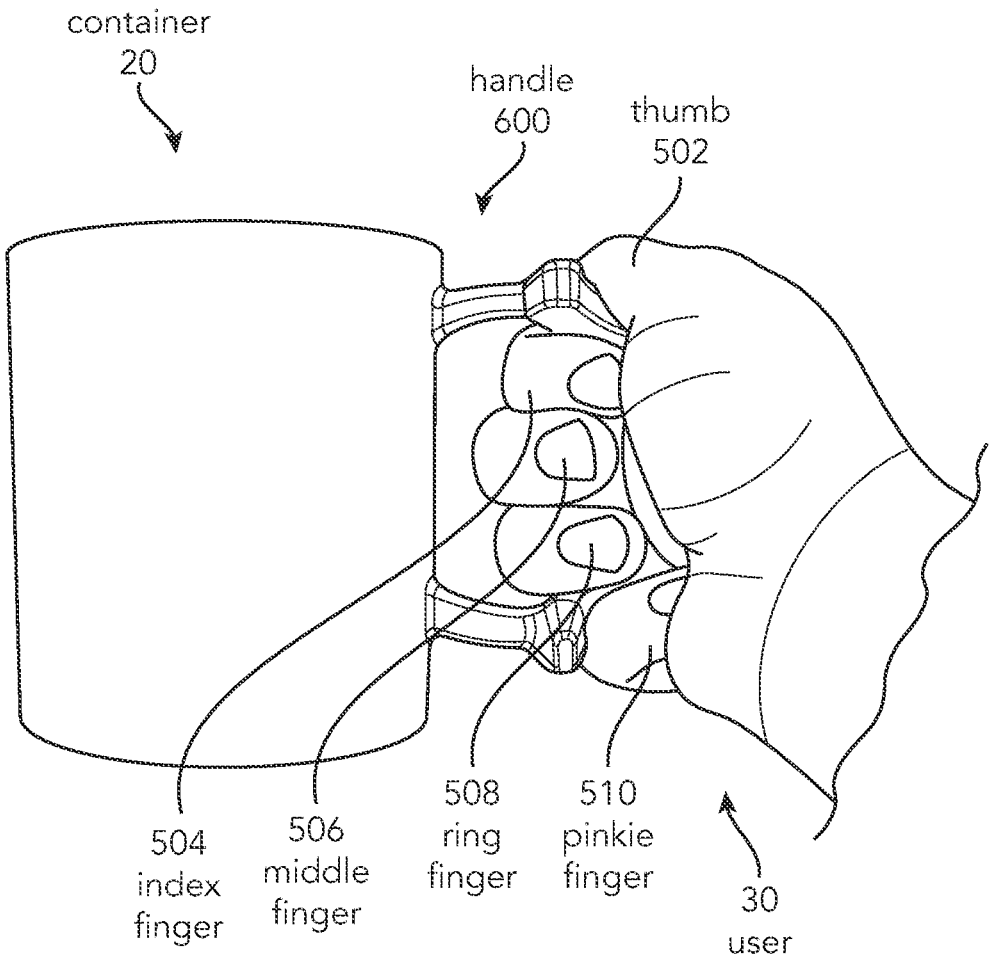
FIG. 10B illustrates an additional side view of a user holding the device of FIG. 6, according to some embodiments.

FIG. 10B illustrates an additional side view of a user holding a device, such as the device of FIG. 6, according to some embodiments. This figure shows a similar view to that of FIG. 10A but illustrates the hand of the user 30 to be at least partially further closed. In some embodiments, the hand in this figure is completing the grip of the handle 600. Like FIG. 10A, FIG. 10B illustrates the thumb 502 of the user 30 restably coupled to the top protrusion 808, although at least a part of a different portion of the thumb 502 is in contact with the top protrusion 808. Also shown in FIG. 10B is the index finger 504, the middle finger 506, and the ring finger 508 extending into and/or through the opening 802, the middle finger 506 restably coupled to the indentation 804 in the middle protrusion 810, and the pinkie finger 510 at least partially in contact with the concavity 806 and/or the bottom protrusion 812*a* and/or 812*b*. However, as opposed to FIG. 10A, the palm of the user 30 is shown in FIG. 10B to be in further contact with the space between the top protrusion 808 and the bottom protrusion 812.

Included in the present disclosure is a container, including a wall extending in at least a first direction and a second direction opposite the first direction. In some embodiments, the container includes a base located in the second direction and extending in at least a third direction and a fourth direction opposite the third direction. According to some embodiments, the container includes a handle extending in the fourth direction. The handle may include an interior. In some embodiments, the handle includes an exterior opposite the interior. According to some embodiments, the container includes an opening defined by at least a portion of the interior of the handle and at least a portion of the wall, whereby the portion of the interior of the handle and the portion of the wall form at least a portion of a perimeter about the opening, the opening configured to receive an index finger of a user. The exterior of the handle may include a protrusion, the protrusion sized and configured to restably couple to a palm of the user.

In some embodiments, the protrusion includes a concavity sized and configured to restably couple to a finger of the user from the group consisting of a middle finger, a ring finger, a pinkie finger, and a combination thereof. According to some embodiments, the portion of the interior of the handle and the portion of the wall form a full perimeter about the opening.

The handle may include ceramic. In some embodiments the handle includes metal. According to some embodiments, the metal includes steel. The handle may include silicone. In some embodiments, the handle includes wood.

According to some embodiments, the container is a mug. The container may be a bowl. In some embodiments, the container is a cup.

According to some embodiments, the handle further includes a first portion extending from the wall in the fourth direction. The handle may further include a second portion opposite the first portion, the second portion closer to the base than the first portion.

In some embodiments, the second portion includes a concave portion opposite the opening, the concave portion configured to receive a middle finger of the user. According to some embodiments, the second portion includes an indentation, the indentation sized and configured to restably couple to the index finger of the user. The first portion may include an indentation, the indentation configured to maneuver the handle in response to manipulation from a thumb of the user.

In some embodiments, the protrusion is a first protrusion, and the handle further includes a second protrusion. According to some embodiments, the interior of the handle includes the second protrusion, the second protrusion extending at least partially in the third direction and configured to maneuver the handle in response to manipulation from a middle finger of the user.

The exterior of the handle may include the second protrusion, the second protrusion extending at least partially in the first direction and the fourth direction, and sized and configured to maneuver the handle in response to manipulation from a thumb of the user. In some embodiments, the exterior of the handle includes the second protrusion, the second protrusion extending at least partially in the fourth direction and sized and configured to restably couple to the palm between a thumb and the index finger of the user.

According to some embodiments, the protrusion extends at least partially in the second direction. The protrusion may extend at least partially in the fourth direction as it extends in the second direction. In some embodiments, the protrusion extends at least partially in the fourth direction. According to some embodiments, the protrusion tapers outward as it extends away from the opening thereby creating a tapered portion sized and configured to restably couple to a finger of the user from the group consisting of a middle finger, a ring finger, a pinkie finger, and a combination thereof.

Also included in the present disclosure is a container, including a wall extending in at least a first direction and a second direction opposite the first direction. In some embodiments, the container includes a base located in the second direction and extending in at least a third direction and a fourth direction opposite the third direction. According to some embodiments, the container includes a handle extending in the fourth direction. The handle may include a first portion. In some embodiments, the handle includes a second portion opposite the first portion, the second portion closer to the base than the first portion. According to some embodiments, the container includes an opening defined by at least a portion of the handle and at least a portion of the wall, whereby the portion of the handle and the portion of the wall form at least a portion of a perimeter about the opening, the opening configured to receive an index finger of a user. The second portion may include a concave portion opposite the opening, the concave portion configured to receive a middle finger of the user.

In some embodiments, the portion of the handle and the portion of the wall form a full perimeter about the opening. According to some embodiments, the handle includes ceramic. The handle may include metal. In some embodiments, the metal includes steel. According to some embodiments, the handle includes silicone. The handle may include wood.

In some embodiments, the container is a mug. According to some embodiments, the container is a bowl. The container may be a cup.

In some embodiments, the second portion includes an indentation, the indentation sized and configured to restably couple to the index finger of the user. According to some embodiments, the first portion includes an indentation, the indentation configured to maneuver the handle in response to manipulation from a thumb of the user.

The handle may further include an interior and an exterior opposite the interior. In some embodiments, the interior of the handle includes a protrusion extending at least partially in the third direction and configured to maneuver the handle in response to manipulation from a middle finger of the user. According to some embodiments, the exterior of the handle includes a protrusion.

The protrusion may be sized and configured to restably couple to a palm of the user. In some embodiments, the protrusion includes a concavity sized and configured to restably couple to a finger of the user from the group consisting of a middle finger, a ring finger, a pinkie finger, and a combination thereof. According to some embodiments, the protrusion extends at least partially in the second direction. The protrusion may extend at least partially in the fourth direction as it extends in the second direction.

In some embodiments, the protrusion extends at least partially in the fourth direction. According to some embodiments, the protrusion tapers outward as it extends away from the opening thereby creating a tapered portion sized and is configured to restably couple to a finger of the user from the group consisting of a middle finger, a ring finger, a pinkie finger, and a combination thereof.

The protrusion may extend at least partially in the first direction and the fourth direction, and may be sized and configured to maneuver the handle in response to manipulation from a thumb of the user. In some embodiments, the protrusion extends at least partially in the fourth direction and is sized and configured to restably couple to a palm between a thumb and the index finger of the user.

Also included in the present disclosure is a container, including a wall extending in at least a first direction and a second direction opposite the first direction. In some embodiments, the container includes a base located in the second direction and extending in at least a third direction and a fourth direction opposite the third direction. According to some examples, the container includes a handle extending in the fourth direction. The handle may include an interior. In some embodiments, the handle includes an exterior opposite the interior. According to some embodiments, the container includes an opening defined by at least a portion of the interior of the handle and at least a portion of the wall, whereby the portion of the interior of the handle and the portion of the wall form at least a portion of a perimeter about the opening, the opening configured to receive an index finger of a user. The interior of the handle may include a protrusion, the protrusion configured to maneuver the handle in response to manipulation from a middle finger of the user.

In some embodiments, the portion of the interior of the handle and the portion of the wall form a full perimeter about the opening. According to some embodiments, the handle includes ceramic. The handle may include metal. In some embodiments, the metal includes steel. According to some embodiments, the handle includes silicone. The handle may include wood.

In some embodiments, the container is a mug. According to some embodiments, the container is a bowl. The container may be a cup.

In some embodiments, the handle further includes a first portion. According to some embodiments, the handle further includes a second portion opposite the first portion, the second portion closer to the base than the first portion. The second portion may include a concave portion opposite the opening, the concave portion configured to receive a middle finger of the user. In some embodiments, the second portion includes an indentation, the indentation sized and configured to restably couple to the index finger of the user. According to some embodiments, the first portion includes an indentation, the indentation configured to maneuver the handle in response to manipulation from a thumb of the user.

The protrusion may be a first protrusion. In some embodiments, the handle further includes a second protrusion. According to some embodiments, the exterior of the handle includes the second protrusion, the second protrusion extending at least partially in the first direction and the fourth direction, and sized and configured to maneuver the handle in response to manipulation from a thumb of the user. The exterior of the handle may include the second protrusion, the second protrusion extending at least partially in the fourth direction and sized and configured to restably couple to a palm between a thumb and the index finger of the user.

In some embodiments, the exterior of the handle includes the second protrusion, the second protrusion sized and configured to restably couple to a palm of the user. According to some embodiments, the second protrusion includes a concavity sized and configured to restably couple to a finger of the user from the group consisting of a middle finger, a ring finger, a pinkie finger, and a combination thereof. The second protrusion may extend at least partially in the second direction. In some embodiments, the second protrusion extends at least partially in the fourth direction as it extends in the second direction.

According to some embodiments, the second protrusion extends at least partially in the fourth direction. The second protrusion may taper outward as it extends away from the opening thereby creating a tapered portion sized and configured to restably couple to a finger of the user from the group consisting of a middle finger, a ring finger, a pinkie finger, and a combination thereof.

Also included in the present disclosure is a container, including a wall extending in at least a first direction and a second direction opposite the first direction. In some embodiments, the container includes a base located in the second direction and extending in at least a third direction and a fourth direction opposite the third direction. According to some embodiments, the container includes a handle extending in the fourth direction. The handle may include a first portion. In some embodiments, the handle includes a second portion opposite the first portion, the second portion closer to the base than the first portion. According to some embodiments, the container includes an opening defined by at least a portion of the handle and at least a portion of the wall, whereby the portion of the handle and the portion of the wall form at least a portion of a perimeter about the opening, the opening configured to receive an index finger of a user. The second portion may include an indentation, the indentation sized and configured to restably couple to the index finger of the user.

In some embodiments, the portion of the handle and the portion of the wall form a full perimeter about the opening. According to some embodiments, the handle includes ceramic. The handle may include metal. In some embodiments, the metal includes steel. According to some embodiments, the handle includes silicone. The handle may include wood.

In some embodiments, the container is a mug. According to some embodiments, the container is a bowl. The container may be a cup.

In some embodiments, the second portion includes a concave portion opposite the opening, the concave portion configured to receive a middle finger of the user. According to some embodiments, the first portion includes an indentation, the indentation configured to maneuver the handle in response to manipulation from a thumb of the user.

The handle may further include an interior and an exterior opposite the interior. In some embodiments, the exterior of the handle includes a protrusion, the protrusion sized and configured to restably couple to a palm of the user. According to some embodiments, the protrusion includes a concavity sized and configured to restably couple to a finger of the user from the group consisting of a middle finger, a ring finger, a pinkie finger, and a combination thereof.

According to some embodiments, the protrusion is a first protrusion. The handle may further include a second protrusion. The interior of the handle may include the second protrusion, the second protrusion extending at least partially in the third direction and configured to maneuver the handle in response to manipulation from a middle finger of the user. In some embodiments, the exterior of the handle includes the second protrusion, the second protrusion extending at least partially in the first direction and the fourth direction, and sized and configured to maneuver the handle in response to manipulation from a thumb of the user. According to some embodiments, the exterior of the handle includes the second protrusion, the second protrusion extending at least partially in the fourth direction and sized and configured to restably couple to the palm between a thumb and the index finger of the user.

The protrusion may extend at least partially in the second direction. In some embodiments, the protrusion extends at least partially in the fourth direction as it extends in the second direction. According to some embodiments, the protrusion extends at least partially in the fourth direction. The protrusion may taper outward as it extends away from the opening thereby creating a tapered portion sized and configured to restably couple to a finger of the user from the group consisting of a middle finger, a ring finger, a pinkie finger, and a combination thereof.

Also included in the present disclosure is a container including a wall extending in at least a first direction and a second direction opposite the first direction. In some embodiments, the container includes a base located in the second direction and extending in at least a third direction and a fourth direction opposite the third direction. According to some embodiments, the container includes a handle extending in the fourth direction. The handle may include a first portion. In some embodiments, the handle includes a second portion opposite the first portion, the second portion closer to the base than the first portion. In some embodiments, the container includes an opening defined by at least a portion of the handle and at least a portion of the wall, whereby the portion of the handle and the portion of the wall form at least a portion of a perimeter about the opening, the opening configured to receive an index finger of a user. According to some examples, the first portion includes an indentation, the indentation configured to maneuver the handle in response to manipulation from a thumb of the user.

The portion of the handle and the portion of the wall may form a full perimeter about the opening. In some embodiments, the handle includes ceramic. According to some embodiments, the handle includes metal. The metal may include steel. In some embodiments, the handle includes silicone. According to some embodiments, the handle includes wood.

The container may be a mug. In some embodiments, the container is a bowl. According to some embodiments, the container is a cup.

The second portion may include a concave portion opposite the opening, the concave portion configured to receive a middle finger of the user. In some embodiments, the second portion includes an indentation, the indentation sized and configured to restably couple to the index finger of the user.

According to some embodiments, the handle further includes an interior and an exterior opposite the interior. The exterior of the handle may include a protrusion, the protrusion sized and configured to restably couple to a palm of the user. In some embodiments, the protrusion includes a concavity sized and configured to restably couple to a finger of the user from the group consisting of a middle finger, a ring finger, a pinkie finger, and a combination thereof.

According to some embodiments, the protrusion is a first protrusion, and the handle further includes a second protrusion. The interior of the handle may include the second protrusion, the second protrusion extending at least partially in the third direction and configured to maneuver the handle in response to manipulation from a middle finger of the user.

In some embodiments, the exterior of the handle includes the second protrusion, the second protrusion extending at least partially in the first direction and the fourth direction, and sized and configured to maneuver the handle in response to manipulation from a thumb of the user. According to some embodiments, the exterior of the handle includes the second protrusion, the second protrusion extending at least partially in the fourth direction and sized and configured to restably couple to the palm between a thumb and the index finger of the user.

The protrusion may extend at least partially in the second direction. In some embodiments, the protrusion extends at least partially in the fourth direction as it extends in the second direction.

According to some embodiments, the protrusion extends at least partially in the fourth direction. The protrusion may taper outward as it extends away from the opening thereby creating a tapered portion sized and configured to restably couple to a finger of the user from the group consisting of a middle finger, a ring finger, a pinkie finger, and a combination thereof.

Also included in the present disclosure is a container, including a wall extending in at least a first direction and a second direction opposite the first direction. In some embodiments, the container includes a base located in the second direction and extending in at least a third direction and a fourth direction opposite the third direction. According to some embodiments, the container includes a handle extending in the fourth direction. The handle may include an interior. In some embodiments, the handle includes an exterior opposite the interior. According to some embodiments, the container includes an opening defined by at least a portion of the interior of the handle and at least a portion of the wall, whereby the portion of the interior of the handle and the portion of the wall form at least a portion of a perimeter about the opening, the opening configured to receive an index finger of a user. The exterior of the handle may include a protrusion, the protrusion sized and configured to maneuver the handle in response to manipulation from a thumb of the user.

In some embodiments, the portion of the interior of the handle and the portion of the wall form a full perimeter about the opening. According to some embodiments, the handle includes ceramic. The handle may include metal. In some embodiments, the metal includes steel. According to some embodiments, the handle includes silicone. The handle may include wood.

In some embodiments, the container is a mug. According to some embodiments, the container is a bowl. The container may be a cup.

In some embodiments, the handle further includes a first portion. According to some embodiments, the handle further includes a second portion opposite the first portion, the second portion closer to the base than the first portion.

The second portion may include a concave portion opposite the opening, the concave portion configured to receive a middle finger of the user. In some embodiments, the second portion includes an indentation, the indentation sized and configured to restably couple to the index finger of the user. According to some embodiments, the first portion includes an indentation, the indentation configured to maneuver the handle in response to manipulation from a thumb of the user.

The protrusion may be a first protrusion, and the handle may further include a second protrusion. In some embodiments, the interior of the handle includes the second protrusion, the second protrusion configured to maneuver the handle in response to manipulation from a middle finger of the user. According to some embodiments, the exterior of the handle includes the second protrusion, the second protrusion extending at least partially in the fourth direction and sized and configured to restably couple to a palm between a thumb and the index finger of the user.

The exterior of the handle may include the second protrusion, the second protrusion sized and configured to restably couple to a palm of the user. In some embodiments, the second protrusion includes a concavity sized and configured to restably couple to a finger of the user from the group consisting of a middle finger, a ring finger, a pinkie finger, and a combination thereof.

According to some embodiments, the second protrusion extends at least partially in the second direction. The second protrusion may extend at least partially in the fourth direction as it extends in the second direction.

In some embodiments, the second protrusion extends at least partially in the fourth direction. According to some embodiments, the second protrusion tapers outward as it extends away from the opening thereby creating a tapered portion sized and configured to restably couple to a finger of the user from the group consisting of a middle finger, a ring finger, a pinkie finger, and a combination thereof.

Also included in the present disclosure is a container, including a wall extending in at least a first direction and a second direction opposite the first direction. In some embodiments, the container includes a base located in the second direction and extending in at least a third direction and a fourth direction opposite the third direction. According to some embodiments, the container includes a handle extending in the fourth direction. The handle may include an interior. In some embodiments, the handle includes an exterior opposite the interior. According to some embodiments, the container includes an opening defined by at least a portion of the interior of the handle and at least a portion of the wall, whereby the portion of the interior of the handle and the portion of the wall form at least a portion of a perimeter about the opening, the opening configured to receive an index finger of a user. The exterior of the handle may include a protrusion, the protrusion sized and configured to restably couple to a palm between a thumb and the index finger of the user.

In some embodiments, the portion of the interior of the handle and the portion of the wall form a full perimeter about the opening. According to some embodiments, the handle includes ceramic. The handle may include metal. In some embodiments, the metal includes steel. According to some embodiments, the handle includes silicone. The handle may include wood.

In some embodiments, the container is a mug. According to some embodiments, the container is a bowl. The container may be a cup.

In some embodiments, the handle further includes a first portion. According to some embodiments, the handle further includes a second portion opposite the first portion, the second portion closer to the base than the first portion.

The second portion may include a concave portion opposite the opening, the concave portion configured to receive a middle finger of the user. In some embodiments, the second portion includes an indentation, the indentation sized and configured to restably couple to the index finger of the user. According to some embodiments, the first portion includes an indentation, the indentation configured to maneuver the handle in response to manipulation from a thumb of the user.

The protrusion may be a first protrusion, and the handle may further include a second protrusion. In some embodiments, the interior of the handle includes the second protrusion, the second protrusion configured to maneuver the handle in response to manipulation from a middle finger of the user. According to some embodiments, the exterior of the handle includes the second protrusion, the second protrusion sized and configured to maneuver the handle in response to manipulation from a thumb of the user.

The exterior of the handle may include the second protrusion, the second protrusion sized and configured to restably couple to a palm of the user. In some embodiments, the second protrusion includes a concavity sized and configured to restably couple to a finger of the user from the group consisting of a middle finger, a ring finger, a pinkie finger, and a combination thereof.

According to some embodiments, the second protrusion extends at least partially in the second direction. The second protrusion may extend at least partially in the fourth direction as it extends in the second direction.

In some embodiments, the second protrusion extends at least partially in the fourth direction. According to some embodiments, the second protrusion tapers outward as it extends away from the opening thereby creating a tapered portion sized and configured to restably couple to a finger of the user from the group consisting of a middle finger, a ring finger, a pinkie finger, and a combination thereof.

Also included in the present disclosure is a handle, including a body extending in a first direction, a second direction opposite the first direction, a third direction at a right angle to the first direction, and a fourth direction opposite the third direction. In some embodiments, the body includes a semi-circular structure including an interior and an exterior opposite the interior, the semi-circular structure extending in the fourth direction sized and configured to receive an index finger of a user. According to some embodiments, the body includes a protrusion extending from the exterior of the semi-circular structure at least partially in the second direction, the protrusion sized and configured to restably couple to a palm of the user.

The protrusion may include a concavity sized and configured to restably couple to a finger of the user from the group consisting of a middle finger, a ring finger, a pinkie finger, and a combination thereof. In some embodiments, the body includes ceramic. According to some embodiments, the body includes metal. The metal may include steel. In some embodiments, the body includes silicone. According to some embodiments, the body includes wood.

The exterior of the semi-circular structure may include a concave portion opposite the index finger of the user at least partially in the second direction, the concave portion configured to receive a middle finger of the user. In some embodiments, the semi-circular structure includes an indentation extending at least partially in the second direction and the fourth direction, the indentation sized and configured to restably couple to the index finger of the user. According to some embodiments, the semi-circular structure includes an indentation extending at least partially in the first direction and the fourth direction, the indentation configured to maneuver the handle in response to manipulation from a thumb of the user.

The protrusion may be a first protrusion, and the body may further include a second protrusion. In some embodiments, the second protrusion extends from the interior of the semi-circular structure at least partially in the third direction and is configured to maneuver the body in response to manipulation from a middle finger of the user.

According to some embodiments, the second protrusion extends from the exterior of the semi-circular structure at least partially in the first direction and the fourth direction, and is sized and configured to maneuver the body in response to manipulation from a thumb of the user. The second protrusion may extend from the exterior of the semi-circular structure at least partially in the fourth direction and may be sized and configured to restably couple to the palm between a thumb and the index finger of the user.

In some embodiments, the protrusion extends at least partially in the fourth direction as it extends in the second direction. According to some embodiments, the protrusion extends at least partially in the fourth direction. The protrusion may taper outward as it extends from the semi-circular structure thereby forming a tapered portion sized and configured to restably couple to a finger of the user from the group consisting of a middle finger, a ring finger, a pinkie finger, and a combination thereof.

Also included in the present disclosure is a handle, including a body extending in a first direction, a second direction opposite the first direction, a third direction at a right angle to the first direction, and a fourth direction opposite the third direction. In some embodiments, the body includes a semi-circular structure including an interior and an exterior opposite the interior, the semi-circular structure extending in the fourth direction sized and configured to receive an index finger of a user. According to some embodiments, the exterior of the semi-circular structure includes a concave portion opposite the index finger of the user at least partially in the second direction, the concave portion configured to receive a middle finger of the user.

The body may include ceramic. In some embodiments, the body includes metal. According to some embodiments, the body includes steel. The body may include silicone. In some embodiments, the body includes wood.

According to some embodiments, the semi-circular structure includes an indentation extending at least partially in the second direction and the fourth direction, the indentation sized and configured to restably couple to the index finger of the user. The semi-circular structure may include an indentation extending at least partially in the first direction and the fourth direction, the indentation configured to maneuver the handle in response to manipulation from a thumb of the user.

In some embodiments, the handle further includes a protrusion extending from the exterior of the semi-circular structure at least partially in the second direction, the protrusion sized and configured to restably couple to a palm of the user. According to some embodiments, the protrusion includes a concavity sized and configured to restably couple to a finger of the user from the group consisting of a middle finger, a ring finger, a pinkie finger, and a combination thereof.

The protrusion may be a first protrusion, and the body may further include a second protrusion. In some embodiments, the second protrusion extends from the interior of the semi-circular structure at least partially in the third direction and is configured to maneuver the body in response to manipulation from a middle finger of the user.

According to some embodiments, the second protrusion extends from the exterior of the semi-circular structure at least partially in the first direction and the fourth direction, and is sized and configured to maneuver the body in response to manipulation from a thumb of the user. The second protrusion may extend from the exterior of the semi-circular structure at least partially in the fourth direction and may be sized and configured to restably couple to the palm between a thumb and the index finger of the user.

In some embodiments, the protrusion extends at least partially in the fourth direction as it extends in the second direction. According to some embodiments, the protrusion extends at least partially in the fourth direction. The protrusion may taper outward as it extends from the semi-circular structure thereby forming a tapered portion sized and configured to restably couple to a finger of the user from the group consisting of a middle finger, a ring finger, a pinkie finger, and a combination thereof.

Also included in the present disclosure is a handle, including a body extending in a first direction, a second direction opposite the first direction, a third direction at a right angle to the first direction, and a fourth direction opposite the third direction. In some embodiments, the body includes a semi-circular structure including an interior and an exterior opposite the interior, the semi-circular structure extending in the fourth direction sized and configured to receive an index finger of a user. According to some embodiments, the body includes a protrusion extending from the interior of the semi-circular structure at least partially in the third direction, the protrusion configured to maneuver the body in response to manipulation from a middle finger of the user.

The body may include ceramic. In some embodiments, the body includes metal. According to some embodiments, the body includes steel. The body may include silicone. In some embodiments, the body includes wood.

According to some embodiments, the exterior of the semi-circular structure includes a concave portion opposite the index finger of the user at least partially in the second direction, the concave portion configured to receive a middle finger of the user. The semi-circular structure may include an indentation extending at least partially in the second direction and the fourth direction, the indentation sized and configured to restably couple to the index finger of the user. In some embodiments, the semi-circular structure includes an indentation extending at least partially in the first direction and the fourth direction, the indentation configured to maneuver the handle in response to manipulation from a thumb of the user.

According to some embodiments, the protrusion is a first protrusion, and the body further includes a second protrusion. The second protrusion may extend from the exterior of the semi-circular structure at least partially in the second direction and is sized and configured to restably couple to a palm of the user.

In some embodiments, the second protrusion includes a concavity sized and configured to restably couple to a finger of the user from the group consisting of a middle finger, a ring finger, a pinkie finger, and a combination thereof. According to some embodiments, the second protrusion extends at least partially in the fourth direction as it extends in the second direction.

The second protrusion may extend at least partially in the fourth direction. In some embodiments, the second protrusion tapers outward as it extends from the semi-circular structure thereby forming a tapered portion sized and configured to restably couple to a finger of the user from the group consisting of a middle finger, a ring finger, a pinkie finger, and a combination thereof.

According to some embodiments, the second protrusion extends from the exterior of the semi-circular structure at least partially in the first direction and the fourth direction, and is sized and configured to maneuver the body in response to manipulation from a thumb of the user. The second protrusion may extend from the exterior of the semi-circular structure at least partially in the fourth direction and is sized and configured to restably couple to a palm between a thumb and the index finger of the user.

Also included in the present disclosure is a handle, including a body extending in a first direction, a second direction opposite the first direction, a third direction at a right angle to the first direction, and a fourth direction opposite the third direction. In some embodiments, the body includes a semi-circular structure including an interior and an exterior opposite the interior, the semi-circular structure extending in the fourth direction sized and configured to receive an index finger of a user. According to some embodiments, the semi-circular structure includes an indentation extending at least partially in the second direction and the fourth direction, the indentation sized and configured to restably couple to the index finger of the user.

The body may include ceramic. In some embodiments, the body includes metal. According to some embodiments, the body includes steel. The body may include silicone. In some embodiments, the body includes wood.

According to some embodiments, the exterior of the semi-circular structure includes a concave portion opposite the index finger of the user at least partially in the second direction, the concave portion configured to receive a middle finger of the user. The semi-circular structure may include an indentation extending at least partially in the first direction and the fourth direction, the indentation configured to maneuver the handle in response to manipulation from a thumb of the user.

In some embodiments, the handle further includes a protrusion extending from the exterior of the semi-circular structure at least partially in the second direction, the protrusion sized and configured to restably couple to a palm of the user. According to some embodiments, the protrusion includes a concavity sized and configured to restably couple to a finger of the user from the group consisting of a middle finger, a ring finger, a pinkie finger, and a combination thereof.

The protrusion may be a first protrusion, and the body may further include a second protrusion. In some embodiments, the second protrusion extends from the interior of the semi-circular structure at least partially in the third direction and is configured to maneuver the body in response to manipulation from a middle finger of the user.

According to some embodiments, the second protrusion extends from the exterior of the semi-circular structure at least partially in the first direction and the fourth direction, and is sized and configured to maneuver the body in response to manipulation from a thumb of the user. The second protrusion may extend from the exterior of the semi-circular structure at least partially in the fourth direction and is sized and configured to restably couple to the palm between a thumb and the index finger of the user.

In some embodiments, the protrusion extends at least partially in the fourth direction as it extends in the second direction. According to some embodiments, the protrusion extends at least partially in the fourth direction. The protrusion may taper outward as it extends from the semi-circular structure thereby forming a tapered portion sized and configured to restably couple to a finger of the user from the group consisting of a middle finger, a ring finger, a pinkie finger, and a combination thereof.

Also included in the present disclosure is a handle, including a body extending in a first direction, a second direction opposite the first direction, a third direction at a right angle to the first direction, and a fourth direction opposite the third direction. In some embodiments, the body includes a semi-circular structure including an interior and an exterior opposite the interior, the semi-circular structure extending in the fourth direction sized and configured to receive an index finger of a user. According to some embodiments, the semi-circular structure includes an indentation extending at least partially in the first direction and the fourth direction, the indentation configured to maneuver the handle in response to manipulation from a thumb of the user.

The body may include ceramic. In some embodiments, the body includes metal. According to some embodiments, the body includes steel. The body may include silicone. In some embodiments, the body includes wood.

In some embodiments, the semi-circular structure includes an indentation extending at least partially in the second direction and the fourth direction, the indentation sized and configured to restably couple to the index finger of the user. According to some embodiments, the exterior of the semi-circular structure includes a concave portion opposite the index finger of the user at least partially in the second direction, the concave portion configured to receive a middle finger of the user.

The handle may further include a protrusion extending from the exterior of the semi-circular structure at least partially in the second direction, the protrusion sized and configured to restably couple to a palm of the user. In some embodiments, the protrusion includes a concavity sized and configured to restably couple to a finger of the user from the group consisting of a middle finger, a ring finger, a pinkie finger, and a combination thereof.

According to some embodiments, the protrusion is a first protrusion, and the body further includes a second protrusion. The second protrusion may extend from the interior of the semi-circular structure at least partially in the third direction and is configured to maneuver the body in response to manipulation from a middle finger of the user.

In some embodiments, the second protrusion extends from the exterior of the semi-circular structure at least partially in the first direction and the fourth direction, and is sized and configured to maneuver the body in response to manipulation from a thumb of the user. According to some embodiments, the second protrusion extends from the exterior of the semi-circular structure at least partially in the fourth direction and is sized and configured to restably couple to the palm between a thumb and the index finger of the user.

The protrusion may extend at least partially in the fourth direction as it extends in the second direction. In some embodiments, the protrusion extends at least partially in the fourth direction. According to some embodiments, the protrusion tapers outward as it extends from the semi-circular structure thereby forming a tapered portion sized and configured to restably couple to a finger of the user from the group consisting of a middle finger, a ring finger, a pinkie finger, and a combination thereof.

Also included in the present disclosure is a handle, including a body extending in a first direction, a second direction opposite the first direction, a third direction at a right angle to the first direction, and a fourth direction opposite the third direction. In some embodiments, the body includes a semi-circular structure includes an interior and an exterior opposite the interior, the semi-circular structure extending in the fourth direction sized and configured to receive an index finger of a user. According to some embodiments, the body includes a protrusion extending from the exterior of the semi-circular structure at least partially in the first direction and the fourth direction, the protrusion sized and configured to maneuver the body in response to manipulation from a thumb of the user.

The body may include ceramic. In some embodiments, the body includes metal. According to some embodiments, the body includes steel. The body may include silicone. In some embodiments, the body includes wood.

According to some embodiments, the exterior of the semi-circular structure includes a concave portion opposite the index finger of the user at least partially in the second direction, the concave portion configured to receive a middle finger of the user. The semi-circular structure may include an indentation extending at least partially in the second direction and the fourth direction, the indentation sized and configured to restably couple to the index finger of the user.

In some embodiments, the semi-circular structure includes an indentation extending at least partially in the first direction and the fourth direction, the indentation configured to maneuver the handle in response to manipulation from a thumb of the user. According to some embodiments, the protrusion is a first protrusion, and the body further includes a second protrusion.

The second protrusion may extend from the exterior of the semi-circular structure at least partially in the second direction and is sized and configured to restably couple to a palm of the user. In some embodiments, the second protrusion includes a concavity sized and configured to restably couple to a finger of the user from the group consisting of a middle finger, a ring finger, a pinkie finger, and a combination thereof.

According to some embodiments, the second protrusion extends at least partially in the fourth direction as it extends in the second direction. The second protrusion may extend at least partially in the fourth direction. In some embodiments, the second protrusion tapers outward as it extends from the semi-circular structure thereby forming a tapered portion sized and configured to restably couple to a finger of the user from the group consisting of a middle finger, a ring finger, a pinkie finger, and a combination thereof.

According to some embodiments, the second protrusion extends from the interior of the semi-circular structure at least partially in the third direction and is configured to maneuver the body in response to manipulation from a middle finger of the user. The second protrusion may extend from the exterior of the semi-circular structure at least partially in the fourth direction and is sized and configured to restably couple to a palm between a thumb and the index finger of the user.

Also included in the present disclosure is a handle, including a body extending in a first direction, a second direction opposite the first direction, a third direction at a right angle to the first direction, and a fourth direction opposite the third direction. In some embodiments, the body includes a semi-circular structure includes an interior and an exterior opposite the interior, the semi-circular structure extending in the fourth direction sized and configured to receive an index finger of a user. According to some embodiments, the body includes a protrusion extending from the exterior of the semi-circular structure at least partially in the fourth direction, the protrusion sized and configured to restably couple to a palm between a thumb and the index finger of the user.

The body may include ceramic. In some embodiments, the body includes metal. According to some embodiments, the body includes steel. The body may include silicone. In some embodiments, the body includes wood.

According to some embodiments, the exterior of the semi-circular structure includes a concave portion opposite the index finger of the user at least partially in the second direction, the concave portion configured to receive a middle finger of the user. The semi-circular structure may include an indentation extending at least partially in the second direction and the fourth direction, the indentation sized and configured to restably couple to the index finger of the user. In some embodiments, the semi-circular structure includes an indentation extending at least partially in the first direction and the fourth direction, the indentation configured to maneuver the handle in response to manipulation from a thumb of the user.

According to some embodiments, the protrusion is a first protrusion, and the body further includes a second protrusion. The second protrusion may extend from the exterior of the semi-circular structure at least partially in the second direction and is sized and configured to restably couple to a palm of the user.

In some embodiments, the second protrusion includes a concavity sized and configured to restably couple to a finger of the user from the group consisting of a middle finger, a ring finger, a pinkie finger, and a combination thereof. According to some embodiments, the second protrusion extends at least partially in the fourth direction as it extends in the second direction.

The second protrusion may extend at least partially in the fourth direction. In some embodiments, the second protrusion tapers outward as it extends from the semi-circular structure thereby forming a tapered portion sized and configured to restably couple to a finger of the user from the group consisting of a middle finger, a ring finger, a pinkie finger, and a combination thereof.

According to some embodiments, the second protrusion extends from the interior of the semi-circular structure at least partially in the third direction and is configured to maneuver the body in response to manipulation from a middle finger of the user. The second protrusion may extend from the exterior of the semi-circular structure at least partially in the first direction and the fourth direction, the second protrusion sized and configured to maneuver the body in response to manipulation from a thumb of the user.

The entirety of the foregoing disclosure may also be further applied to additional embodiments as detailed below.

Also included in the present disclosure is a device, including a container. In some embodiments, the container includes a wall extending in at least a first direction and a second direction opposite the first direction. According to some embodiments, the container includes a base located in the second direction and extending in at least a third direction and a fourth direction opposite the third direction. The device may include a handle extending in the fourth direction. In some embodiments, the handle includes an interior. According to some embodiments, the handle includes an exterior opposite the interior. The handle may include a container engagement portion configured to detachably couple the handle to the wall. In some embodiments, the device includes an opening defined by at least a portion of the interior of the handle and at least a portion of the wall, whereby the portion of the interior of the handle and the portion of the wall form at least a portion of a perimeter about the opening, the opening configured to receive an index finger of a user. According to some embodiments, the exterior of the handle includes a protrusion, the protrusion sized and configured to restably couple to a palm of the user.

The handle may further include a first portion including a container engagement portion, the container engagement portion configured to detachably couple the handle to the container. In some embodiments, the handle further includes a second portion opposite the first portion, the second portion closer to the base than the first portion.

According to some embodiments, the handle detachably couples to the container via a clip. The handle may further include a ring configured to detachably couple about the container. In some embodiments, the handle detachably couples to the container via a magnet. According to some embodiments, the handle detachably couples to the container via adhesive.

The handle may detachably couple to the container via a clamp. In some embodiments, the handle detachably couples to the container via a strap. According to some embodiments, the handle detachably couples to the container via a suction cup.

Also included in the present disclosure is a device, including a container. In some embodiments, the container includes a wall extending in at least a first direction and a second direction opposite the first direction. According to some embodiments, the container includes a base located in the second direction and extending in at least a third direction and a fourth direction opposite the third direction. The device may include a handle extending in the fourth direction. In some embodiments, the handle includes a first portion including a container engagement portion, the container engagement portion configured to detachably couple the handle to the container. According to some embodiments, the handle includes a second portion opposite the first portion, the second portion closer to the base than the first portion. The device may include an opening defined by at least a portion of the handle and at least a portion of the wall, whereby the portion of the handle and the portion of the wall form at least a portion of a perimeter about the opening, the opening configured to receive an index finger of a user. In some embodiments, the second portion includes a concave portion opposite the opening, the concave portion configured to receive a middle finger of the user.

According to some embodiments, the handle detachably couples to the container via a clip. The handle may further include a ring configured to detachably couple about the container. In some embodiments, the handle detachably couples to the container via a magnet. According to some embodiments, the handle detachably couples to the container via adhesive.

The handle may detachably couple to the container via a clamp. In some embodiments, the handle detachably couples to the container via a strap. According to some embodiments, the handle detachably couples to the container via a suction cup.

Also included in the present disclosure is a device, including a container. In some embodiments, the container includes a wall extending in at least a first direction and a second direction opposite the first direction. According to some embodiments, the container includes a base located in the second direction and extending in at least a third direction and a fourth direction opposite the third direction. The device may include a handle extending in the fourth direction. In some embodiments, the handle includes an interior. According to some embodiments, the handle includes an exterior opposite the interior. The handle may include a container engagement portion configured to detachably couple the handle to the wall. In some embodiments, the device includes an opening defined by at least a portion of the interior of the handle and at least a portion of the wall, whereby the portion of the interior of the handle and the portion of the wall form at least a portion of a perimeter about the opening, the opening configured to receive an index finger of a user. According to some embodiments, the interior of the handle includes a protrusion, the protrusion configured to maneuver the handle in response to manipulation from a middle finger of the user.

The handle may further include a first portion including a container engagement portion, the container engagement portion configured to detachably couple the handle to the container. In some embodiments, the handle further includes a second portion opposite the first portion, the second portion closer to the base than the first portion.

According to some embodiments, the handle detachably couples to the container via a clip. The handle may further include a ring configured to detachably couple about the container. In some embodiments, the handle detachably couples to the container via a magnet. According to some embodiments, the handle detachably couples to the container via adhesive.

The handle may detachably couple to the container via a clamp. In some embodiments, the handle detachably couples to the container via a strap. According to some embodiments, the handle detachably couples to the container via a suction cup.

Also included in the present disclosure is a device, including a container. In some embodiments, the container includes a wall extending in at least a first direction and a second direction opposite the first direction. According to some embodiments, the container includes a base located in the second direction and extending in at least a third direction and a fourth direction opposite the third direction. The device may include a handle extending in the fourth direction. In some embodiments, the handle includes a first portion including a container engagement portion, the container engagement portion configured to detachably couple the handle to the container. According to some embodiments, the handle includes a second portion opposite the first portion, the second portion closer to the base than the first portion. The device may include an opening defined by at least a portion of the handle and at least a portion of the wall, whereby the portion of the handle and the portion of the wall form at least a portion of a perimeter about the opening, the opening configured to receive an index finger of a user. In some embodiments, the second portion includes an indentation, the indentation sized and configured to restably couple to the index finger of the user.

According to some embodiments, the handle detachably couples to the container via a clip. The handle may further include a ring configured to detachably couple about the container. In some embodiments, the handle detachably couples to the container via a magnet. According to some embodiments, the handle detachably couples to the container via adhesive.

The handle may detachably couple to the container via a clamp. In some embodiments, the handle detachably couples to the container via a strap. According to some embodiments, the handle detachably couples to the container via a suction cup.

Also included in the present disclosure is a device, including a container. In some embodiments, the container includes a wall extending in at least a first direction and a second direction opposite the first direction. According to some embodiments, the container includes a base located in the second direction and extending in at least a third direction and a fourth direction opposite the third direction. The device may include a handle extending in the fourth direction. In some embodiments, the handle includes a first portion including a container engagement portion, the container engagement portion configured to detachably couple the handle to the container. According to some embodiments, the handle includes a second portion opposite the first portion, the second portion closer to the base than the first portion. The device may include an opening defined by at least a portion of the handle and at least a portion of the wall, whereby the portion of the handle and the portion of the wall form at least a portion of a perimeter about the opening, the opening configured to receive an index finger of a user. In some embodiments, the first portion includes an indentation, the indentation configured to maneuver the handle in response to manipulation from a thumb of the user.

According to some embodiments, the handle detachably couples to the container via a clip. The handle may further include a ring configured to detachably couple about the container. In some embodiments, the handle detachably couples to the container via a magnet. According to some embodiments, the handle detachably couples to the container via adhesive.

The handle may detachably couple to the container via a clamp. In some embodiments, the handle detachably couples to the container via a strap. According to some embodiments, the handle detachably couples to the container via a suction cup.

Also included in the present disclosure is a device, including a container. In some embodiments, the container includes a wall extending in at least a first direction and a second direction opposite the first direction. According to some embodiments, the container includes a base located in the second direction and extending in at least a third direction and a fourth direction opposite the third direction. The device may include a handle extending in the fourth direction. In some embodiments, the handle includes an interior. According to some embodiments, the handle includes an exterior opposite the interior. The handle may include a container engagement portion configured to detachably couple the handle to the wall. In some embodiments, the device includes an opening defined by at least a portion of the interior of the handle and at least a portion of the wall, whereby the portion of the interior of the handle and the portion of the wall form at least a portion of a perimeter about the opening, the opening configured to receive an index finger of a user. According to some embodiments, the exterior of the handle includes a protrusion, the protrusion sized and configured to maneuver the handle in response to manipulation from a thumb of the user.

The handle may further include a first portion including a container engagement portion, the container engagement portion configured to detachably couple the handle to the container. In some embodiments, the handle further includes a second portion opposite the first portion, the second portion closer to the base than the first portion.

According to some embodiments, the handle detachably couples to the container via a clip. The handle may further include a ring configured to detachably couple about the container. In some embodiments, the handle detachably couples to the container via a magnet. According to some embodiments, the handle detachably couples to the container via adhesive.

The handle may detachably couple to the container via a clamp. In some embodiments, the handle detachably couples to the container via a strap. According to some embodiments, the handle detachably couples to the container via a suction cup.

Also included in the present disclosure is a device, including a container. In some embodiments, the container includes a wall extending in at least a first direction and a second direction opposite the first direction. According to some embodiments, the container includes a base located in the second direction and extending in at least a third direction and a fourth direction opposite the third direction. The device may include a handle extending in the fourth direction. In some embodiments, the handle includes an interior. According to some embodiments, the handle includes an exterior opposite the interior. The handle may include a container engagement portion configured to detachably couple the handle to the wall. In some embodiments, the device includes an opening defined by at least a portion of the interior of the handle and at least a portion of the wall, whereby the portion of the interior of the handle and the portion of the wall form at least a portion of a perimeter about the opening, the opening configured to receive an index finger of a user. According to some embodiments, the exterior of the handle includes a protrusion, the protrusion sized and configured to restably couple to a palm between a thumb and the index finger of the user.

The handle may further include a first portion including a container engagement portion, the container engagement portion configured to detachably couple the handle to the container. In some embodiments, the handle further includes a second portion opposite the first portion, the second portion closer to the base than the first portion.

According to some embodiments, the handle detachably couples to the container via a clip. The handle may further include a ring configured to detachably couple about the container. In some embodiments, the handle detachably couples to the container via a magnet. According to some embodiments, the handle detachably couples to the container via adhesive.

The handle may detachably couple to the container via a clamp. In some embodiments, the handle detachably couples to the container via a strap. According to some embodiments, the handle detachably couples to the container via a suction cup.

Some of the components listed herein use the same number from figure to figure. It should be appreciated these components use the same numbers solely for ease of reference and to facilitate comprehension for the reader. While these components may use the same numbers, differences may be present in these components as illustrated in the various figures in which they appear and as described in the specification herein.

None of the steps described herein is essential or indispensable. Any of the steps can be adjusted or modified. Other or additional steps can be used. Any portion of any of the steps, processes, structures, and/or devices disclosed or illustrated in one embodiment, flowchart, or example in this specification can be combined or used with or instead of any other portion of any of the steps, processes, structures, and/or devices disclosed or illustrated in a different embodiment, flowchart, or example. The embodiments and examples provided herein are not intended to be discrete and separate from each other.

The section headings and subheadings provided herein are nonlimiting. The section headings and subheadings do not represent or limit the full scope of the embodiments described in the sections to which the headings and subheadings pertain. For example, a section titled "Topic 1" may include embodiments that do not pertain to Topic 1 and embodiments described in other sections may apply to and be combined with embodiments described within the "Topic 1" section.

The various features and processes described above may be used independently of one another, or may be combined in various ways. All possible combinations and subcombinations are intended to fall within the scope of this disclosure. In addition, certain method, event, state, or process blocks may be omitted in some implementations. The methods, steps, and processes described herein are also not limited to any particular sequence, and the blocks, steps, or states relating thereto can be performed in other sequences that are appropriate. For example, described tasks or events may be performed in an order other than the order specifically disclosed. Multiple steps may be combined in a single block or state. The example tasks or events may be performed in serial, in parallel, or in some other manner. Tasks or events may be added to or removed from the disclosed example embodiments. The example systems and components described herein may be configured differently than described. For example, elements may be added to, removed from, or rearranged compared to the disclosed example embodiments.

Conditional language used herein, such as, among others, "can," "could," "might," "may," "e.g.," and the like, unless specifically stated otherwise, or otherwise understood within the context as used, is generally intended to convey that certain embodiments include, while other embodiments do not include, certain features, elements and/or steps. Thus, such conditional language is not generally intended to imply that features, elements and/or steps are in any way required for one or more embodiments or that one or more embodiments necessarily include logic for deciding, with or without author input or prompting, whether these features, elements and/or steps are included or are to be performed in any particular embodiment. The terms "comprising," "including," "having," and the like are synonymous and are used inclusively, in an open-ended fashion, and do not exclude additional elements, features, acts, operations and so forth. Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, or Z. Thus, such conjunctive language is not generally intended to imply that certain embodiments require at least one of X, at least one of Y, and at least one of Z to each be present.

The term "and/or" means that "and" applies to some embodiments and "or" applies to some embodiments. Thus, A, B, and/or C can be replaced with A, B, and C written in one sentence and A, B, or C written in another sentence. A, B, and/or C means that some embodiments can include A and B, some embodiments can include A and C, some embodiments can include B and C, some embodiments can only include A, some embodiments can include only B, some embodiments can include only C, and some embodiments can include A, B, and C. The term "and/or" is used to avoid unnecessary redundancy.

I claim:

1. A container, comprising:

a wall extending in at least a first direction and a second direction opposite the first direction;

a base adjacent to the wall and extending in at least a third direction and a fourth direction opposite the third direction; and a handle extending at least partially in the fourth direction, comprising:

a first portion having a first end extending from the wall and a second end opposite the first end;

a second portion opposite the first portion, the second portion having a third end extending from the wall and a fourth end opposite the third end, the second portion closer to the base than the first portion, the second end and the fourth end extending from each other;

an interior defined at least partially by the first portion, the second portion, and the wall and configured to receive an index finger of a user; and an exterior opposite the interior;

wherein the exterior of the handle comprises:

a first protrusion extending away from the first portion and at least partially in the first direction and the fourth direction;

a second protrusion extending at least partially in the fourth direction, and a third protrusion extending at least partially in the second direction and the fourth direction, wherein the first protrusion forms a ledge relative to the second protrusion, and wherein the second protrusion forms a ledge relative to the third protrusion.

2. The container of claim 1, wherein the first protrusion is sized and configured to maneuver the handle in response to manipulation from a thumb of the user.

3. The container of claim 1, wherein the second protrusion is configured to restably couple to a palm between a thumb and the index finger of the user.

4. The container of claim 1, wherein the handle is detachably coupled to the wall.

5. The container of claim 3, wherein the third protrusion comprises a concavity sized and configured to restably couple to a finger of the user from the group consisting of a middle finger, a ring finger, a pinkie finger, and combinations thereof.

6. The container of claim 1, wherein the second protrusion extends from the first portion.

7. The container of claim 1, wherein the second protrusion extends from the second portion.

8. A container, comprising:

a wall extending in at least a first direction and a second direction opposite the first direction;

a base located adjacent to the wall and extending in at least a third direction and a fourth direction opposite the third direction;

a handle extending at least partially in the fourth direction, comprising:

a first portion;

a second portion opposite the first portion, the second portion closer to the base than the first portion;

an interior defined at least partially by the first portion, the second portion, and the wall and configured to receive an index finger of a user; and an exterior opposite the interior;

wherein the exterior of the handle comprises a first protrusion sized and configured to restably couple to a palm and a middle finger of the user, wherein the exterior of the handle comprises a second protrusion sized and configured to restably couple to the palm between a thumb and the index finger of the user, wherein the exterior of the handle comprises a third protrusion sized and configured to restably couple to the thumb of the user, wherein the second protrusion extends away from the wall, such that the second protrusion forms a ledge facing towards the first protrusion, and wherein the third protrusion extends away from the wall and the base so as to form a ledge relative to the second protrusion.

9. The container of claim 8, wherein the second portion comprises an indentation sized and configured to restably couple to the index finger of the user, the indentation formed on a face of the handle between the interior and the exterior and extending at least partially onto at least one of the first protrusion and the second protrusion.

10. The container of claim 8, wherein the first portion comprises an indentation configured to maneuver the handle in response to manipulation from a thumb of the user, the indentation formed on a face of the handle between the interior and the exterior.

11. The container of claim 8, wherein the first protrusion comprises a concavity sized and configured to restably couple to a finger of the user from the group consisting of the middle finger, a ring finger, a pinkie finger, and combinations thereof.

12. The container of claim 8, wherein the first protrusion tapers outward as it extends away from the interior, thereby creating a tapered portion sized and configured to restably couple to a finger of the user selected from the group consisting of the middle finger, a ring finger, a pinkie finger, and combinations thereof.

13. The container of claim 8, wherein the first portion comprises a first end and a second end, the first end configured to couple to the wall, and wherein the second protrusion extends from the second end.

14. The container of claim 8, wherein the second portion comprises a first end and a second end, the first end configured to couple to the wall, and wherein at least one of the first protrusion and the second protrusion extends from the second end.

15. The container of claim 8, wherein the first portion comprises a first end extending from the wall and a second end opposite the first end, and the second portion comprises a third end extending from the wall and a fourth end opposite the third end, the second end and the fourth end extending from each other.

16. A container, comprising:

a wall extending in at least a first direction and a second direction opposite the first direction;

a base located adjacent to the wall and extending in at least a third direction and a fourth direction opposite the third direction;

a handle extending at least partially in the fourth direction, comprising:

an interior; and an exterior opposite the interior; and an opening defined by at least a portion of the interior of the handle and at least a portion of the wall, whereby the portion of the interior of the handle and the portion of the wall form at least a portion of a perimeter about the opening, the opening configured to receive an index finger of a user;

wherein the exterior of the handle comprises:

a first protrusion sized and configured to restably couple to a palm and a middle finger of the user;

a second protrusion sized and configured to restably couple to the palm between a thumb and the index finger of the user, the second protrusion extending at least partially in a fourth direction so as to form at least one ledge relative to the first protrusion; and a third protrusion sized and configured to maneuver the handle in response to manipulation from the thumb of the user, the third protrusion extending at least partially in the first direction and the fourth direction so as to form at least one ledge relative to the second protrusion.

17. The container of claim 16, wherein the first protrusion comprises a concavity sized and configured to restably couple to a finger of the user from the group consisting of the middle finger, a ring finger, a pinkie finger, and combinations thereof.

18. The container of claim 16, wherein the handle is detachably coupled to the wall.

19. The container of claim 16, wherein the first protrusion extends at least partially in the second direction and the fourth direction, and the first protrusion curves away from the wall.

20. The container of claim 16, wherein the first protrusion has a first edge and a second edge opposite the first edge, at least a portion of the first edge at least partially concave and at least a portion of the second edge at least partially convex, the first edge further from the wall than the second edge.

* * * * *